US009566627B2

(12) United States Patent
Timmons et al.

(10) Patent No.: US 9,566,627 B2
(45) Date of Patent: Feb. 14, 2017

(54) APPARATUS FOR ADJUSTING THE LIE AND LOFT OF A GOLF CLUB HEAD

(75) Inventors: Alex L. Timmons, Huntington Beach, CA (US); Sharon J. Park, Irvine, CA (US); Scott A. Carlyle, Costa Mesa, CA (US); Brian D. Schielke, Los Angeles, CA (US); Dustin J. Brekke, Fountain Valley, CA (US); John J. Rae, Westminster, CA (US); Ed Mitchell, Centerville, OH (US); Tom Mitchell, Miamisburg, OH (US)

(73) Assignee: SRI SPORTS LIMITED, Kobe-shi (JP)

( * ) Notice: Subject to any disclaimer, the term of this patent is extended or adjusted under 35 U.S.C. 154(b) by 1287 days.

(21) Appl. No.: 13/030,705

(22) Filed: Feb. 18, 2011

(65) Prior Publication Data

US 2011/0209516 A1 Sep. 1, 2011

Related U.S. Application Data

(60) Provisional application No. 61/377,796, filed on Aug. 27, 2010, provisional application No. 61/308,629, filed on Feb. 26, 2010.

(51) Int. Cl.
*B21D 3/16* (2006.01)

(52) U.S. Cl.
CPC ..... *B21D 3/16* (2013.01)

(58) Field of Classification Search
CPC ..... B21D 3/00; B21D 3/10; B21D 3/16; B21D 7/02; B21D 7/024; B21D 7/025; B21D 7/14
USPC .... 72/31.02–31.04, 293, 295–297, 459, 316; 33/508
See application file for complete search history.

(56) References Cited

U.S. PATENT DOCUMENTS

| | | | | |
|---|---|---|---|---|
| 3,357,219 | A | 12/1967 | Hunter | |
| 3,439,429 | A | 4/1969 | Sundstrom et al. | |
| 3,965,714 | A * | 6/1976 | Beard | 72/297 |
| 4,245,391 | A | 1/1981 | Heller | |
| 4,245,392 | A | 1/1981 | Heller | |
| 4,620,431 | A | 11/1986 | Muldoon | |
| 4,622,836 | A * | 11/1986 | Long et al. | 72/31.02 |
| 4,640,017 | A | 2/1987 | Cukon | |
| 4,669,173 | A * | 6/1987 | Chaney, Sr. | 29/525.12 |
| 5,327,766 | A | 7/1994 | Humphreys | |
| 5,421,098 | A | 6/1995 | Muldoon | |

(Continued)

FOREIGN PATENT DOCUMENTS

| | | | |
|---|---|---|---|
| DE | 3416678 | A1 * | 1/1985 |
| JP | U 3090899 | | 10/2002 |
| JP | A 2007-050170 | | 3/2007 |

OTHER PUBLICATIONS

Machine Translation from Espacenet of DE 3416678 A1.*

(Continued)

*Primary Examiner* — Moshe Wilensky
*Assistant Examiner* — Pradeep C Battula
(74) *Attorney, Agent, or Firm* — Oliff PLC

(57) ABSTRACT

An apparatus includes an actuator having an actuation axis, a base having a base plane, a first actuator mount for associating the actuator with the base in a first position, and a second actuator mount for associating the actuator with the base in a second position, and a clamp for associating the golf club head with the base. If the actuator is in the first position, the actuation axis is substantially perpendicular to the base plane, and, if the actuator is in the second position, the actuation axis is oblique relative to the base plane.

12 Claims, 28 Drawing Sheets

(56) References Cited

U.S. PATENT DOCUMENTS

| | | | |
|---|---|---|---|
| 5,884,409 | A | 3/1999 | Muldoon |
| 5,974,645 | A | 11/1999 | Currie |
| 6,363,620 | B1 | 4/2002 | Goodjohn |
| 6,508,007 | B1 | 1/2003 | Muldoon |
| 6,871,414 | B2 | 3/2005 | Burney et al. |
| 7,164,473 | B2 | 1/2007 | Goodjohn |
| 2009/0222206 | A1 | 9/2009 | Burns et al. |

OTHER PUBLICATIONS

Golfsmith Professional Loft/Lie Machine, Jun. 18, 2009, obtained from: http://www.golfsmith.com/products/8325/Golfsmith/Professional_Loft/Lie_Machine.

Golfsmith Putter Bending Bar, May 1, 2008, obtained from: http://reviews.golfsmith.com/8567/293226/putter-bending-bar-reviews/reviews.htm.

Maltby Iron/Hybrid Bending Machine, Jul. 24, 2009, obtained from: http://www.golfworks.com/product.asp_Q_pn_E_MA2017.

Maltby Design® Golf Club Machine, Jul. 17, 2009, obtained from: http://www.golfworks.com/product.asp_Q_pn_E_GAM.

Maltby Premium Golf Club Bending Machine, Sep. 9, 2009, obtained from http://www.golfworks.com/product.asp_Q_pn_E_MA2019.

Mitchell Steelclub® Signature Angle Machine, Jul. 17, 2009, obtained from http://www.mitchellgolf.com/products/STEELCLUB_Signature_Angle_Machine-352-110.html.

"How Many Degrees Can Golf Clubs Be Bent?," Dec. 15, 2006, obtained from http://tourvanrepair.com/2006/how-many-degrees-can-golf-clubs-be-bent.

* cited by examiner

APPARATUS FOR ADJUSTING THE LIE AND LOFT OF A GOLF CLUB HEAD

RELATED U.S. APPLICATIONS

This application claims priority to Provisional Application No. 61/308,629, filed on Feb. 26, 2010, and Provisional Application No. 61/377,796, filed on Aug. 27, 2010, each of which are hereby incorporated by reference in their entirety.

COPYRIGHT AUTHORIZATION

The disclosure below may be subject to copyright protection. The copyright owner has no objection to the facsimile reproduction by anyone of the documents containing this disclosure, as they appear in the Patent and Trademark Office records, but otherwise reserves all applicable copyrights.

BACKGROUND

It is generally known to those skilled in the art that customizing a golf club to the specific needs of a player tends to improve the player's performance. A golf club may be custom fit in various ways, including adjustment of its lie and loft angles.

To adjust the lie and loft angles of a golf club, technicians commonly use a device that includes a clamp attached to a supporting base for holding the head of the golf club in a fixed position. A manual force is then applied to a bending bar that engages the golf club to perform the requisite adjustments. The supporting base must be heavy and/or permanently anchored down to be able to accommodate the forces applied to the club head via the bending bar, without spatial movement of the entire device. Moreover, the abrupt nature of the applied force creates a risk of damaging the club head. Also, the manual aspect of the process makes accurate adjustment of loft and/or lie angle difficult to achieve for the operator, absent extensive familiarity with the device.

Automated devices for reconfiguring golf club heads are also known. However, these devices are generally bulky, non-portable, and expensive, as they include many complex parts.

SUMMARY OF THE INVENTION

The present invention, in one or more aspects thereof, may advantageously comprise an apparatus for adjusting the lie and loft of a golf club head. The apparatus is favorably configured to promote compactness, portability, as well as ease and accuracy of club head adjustment.

In one example, an apparatus, according to one or more aspects of the present invention, may include an actuator having an actuation axis, a base having a base plane, a first actuator mount for associating the actuator with the base in a first position, a second actuator mount for associating the actuator with the base in a second position, and a clamp for associating the golf club head with the base. If the actuator is in the first position, the actuation axis is substantially perpendicular to the base plane. If the actuator is in the second position, the actuation axis is oblique relative to the base plane.

In another example, an apparatus, according to one or more aspects of the present invention, may include a push-pull actuator, a base having a base plane, a first discrete actuator mount that associates the push-pull actuator with the base at a first location, a second discrete actuator mount that associates the push-pull actuator with the base at a second location, and a clamp for associating the golf club head with the base. The first location is different from the second location. The push-pull actuator is movable between the first and second locations.

In another example, an apparatus, according to one or more aspects of the present invention, may include a base having a base plane, a clamp for associating the golf club head with the base, an actuator associated with the base, the actuator including an actuation axis substantially non-parallel to the base plane, and a first engagement portion for slideably engaging with the coupling.

In another example, an apparatus, according to one or more aspects of the present invention, may include a base having a base plane, a clamp for associating the golf club head with the base, and an actuator fixedly associated with the base. The actuator may include an actuation axis that is substantially non-parallel to the base plane. The base is configured such that the clamp and the actuator are rotatable with respect to each other.

In another example, a coupling, according to one or more aspects of the present invention, may include a first end and a second end opposing the first end, a first slotted head having a first center point and having a first head axis, the first slotted head located at the first end, a second slotted head having a second center point and having a second head axis, the second slotted head located at the second end, and an elbow located intermediate the first slotted head and the second slotted head.

In another example, a coupling, according to one or more aspects of the present invention, may include a first end and a second end opposing the first end, a first slotted head located at the first end, the first slotted head having a first center point and a first head axis, a second slotted head located at the second end, the second slotted head having a second center point and a second head axis, an imaginary center line passing through the first center point and the second center point, a first angle measured between the first head axis and the imaginary center line, and a second angle, measured between the second head axis and the imaginary center line, that is different from the first angle.

In another example, a kit, according to one or more aspects of the present invention, may include an actuator having an actuation axis, a first actuator mount for associating the actuator with the base in a first position, and a second actuator mount for associating the actuator with the base in a second position. The first actuator mount is configured such that, if the first actuator mount is engaged with the actuator, and if the first actuator mount is engaged with the base of the golf club clamping device, then the actuation axis of the actuator is substantially perpendicular to a base plane defined by the base of the clamping device. The second actuator mount is configured such that, if the second actuator mount is engaged with the actuator, and if the second actuator mount is engaged with the base of the clamping device, then the actuation axis of the actuator is oblique relative to the base plane.

These and other features and advantages of the apparatus according to the invention in its various aspects, as provided by one or more of the examples described in detail below, will become apparent after consideration of the ensuing description, the accompanying drawings, and the appended claims. The accompanying drawings are for illustrative purposes only and are not intended to limit the scope of the present invention.

BRIEF DESCRIPTION OF THE DRAWINGS

The present invention, in one or more aspects thereof, is illustrated by way of example and not by way of limitation, in the figures of the accompanying drawings, where.

For purposes of illustration, these figures are not necessarily drawn to scale. In all the figures, same or similar elements are designated by the same reference numerals.

DETAILED DESCRIPTION

Figure 1A:
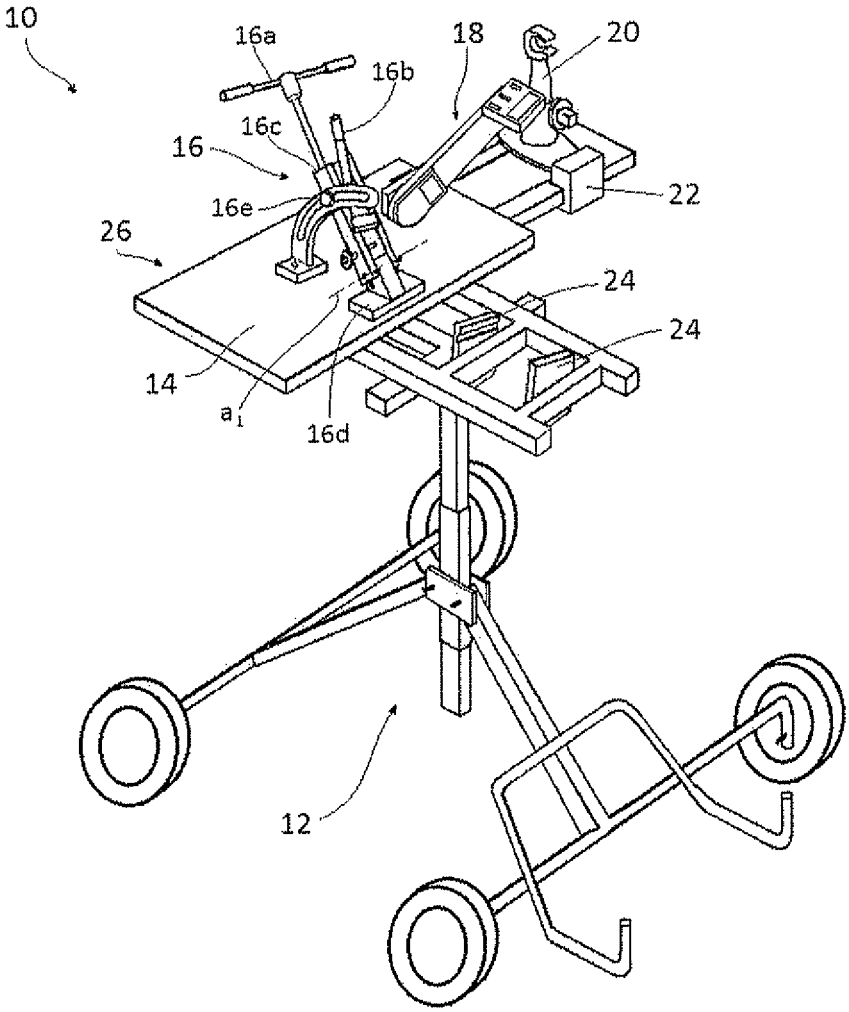
FIG. 1(A) is a front perspective view of an exemplary apparatus according to one or more aspects of the present invention.

Representative examples of one or more novel and nonobvious aspects and features of the golf club head according to the present invention, disclosed below, are not intended to be limiting in any manner. Furthermore, the various aspects and features of the present invention may be used alone or in a variety of novel and nonobvious combinations and subcombinations with one another.

Referring to FIGS. 1(A)-1(H), in one or more aspects of the present invention, an apparatus 10 includes a base 14 having a base plane 26, an actuator 20, an angular-displacement gauge 18, a clamp 16, and actuator mounts 22 and 24. The apparatus 10 is mounted on a movable cart 12. The clamp 16 is rigidly attached to the base 14, e.g., with screws (not shown), and is configured to securely hold a golf club 48, as illustrated, e.g., in FIG. 1(B), in any of a plurality of orientations. The apparatus may be configured to be in a first operating position (see FIG. 1(B)) or a second operating position (see FIG. 1(D)). The golf club 48 shown is an iron-type golf club head with no offset hosel. Additionally, the apparatus 10 and clamp 16 may be modified to accommodate putter-type and wood-type golf clubs.

Figure 1B:
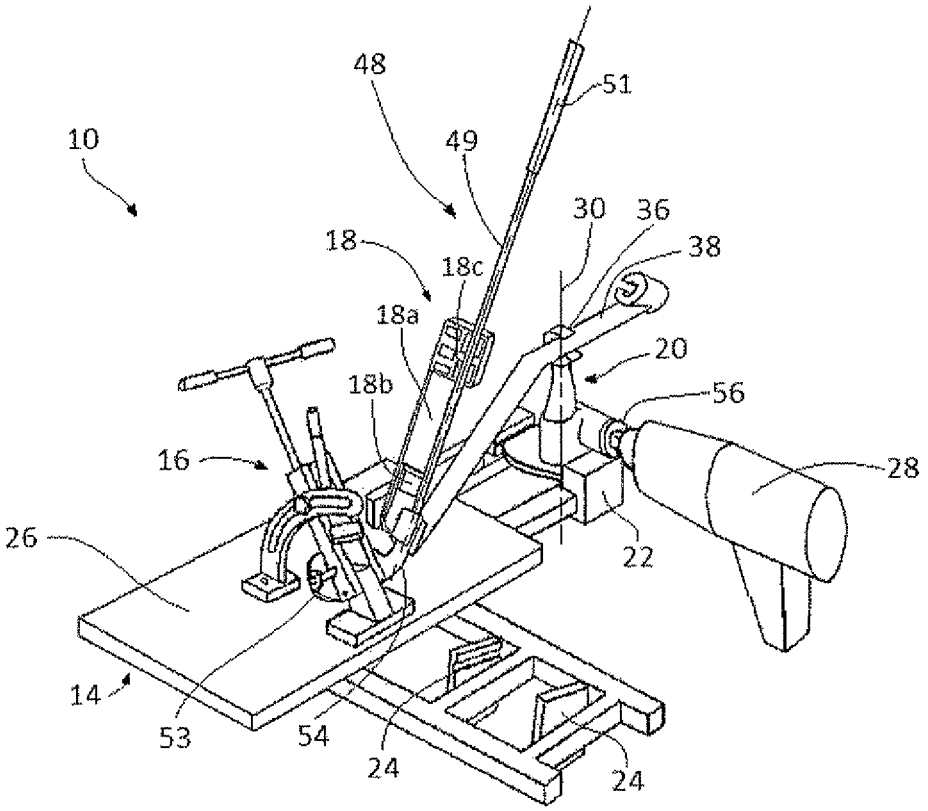
FIG. 1(B) is a front perspective view of a portion of the exemplary apparatus of FIG. 1(A), in a first operating position, according to one or more aspects of the present invention.

As shown in FIG. 1(B), the clamp 16 is preferably configured to secure the golf club 48 in a position such that the shaft 49 of the golf club 48 generally extends away from the base 14 in a plane substantially perpendicular to the base plane 26 and at an angle, relative to the base plane 26, substantially corresponding to the lie angle of the golf club 48, designated by the manufacturer.

Referring again to FIG. 1(A), the clamp 16 may be the same or similar to clamping devices used in the Mitchell® STEELCLUB® Signature Angle Machine, available from Mitchell® Golf Equipment Company of Centerville, Ohio, or the Maltby® Premium Golf Club Bending Machine (Model No. MA2020), available from The GolfWorks of Newark, Ohio. Specifically, the clamp 16 includes a club head fastener 16*a*, a position fastener 16*b*, a pivoting portion 16*c*, a clamp base 16*d*, and a loft angle indicator 16*e*. The club head fastener 16*a* is configured to secure the golf club 48 thereto (see FIG. 1(B)). The position fastener 16*b* is configured to secure the pivoting portion 16*c* in a user-selectable angular position. Specifically, the pivoting portion 16*c* is configured to pivot about axis $a_1$. The pivoting portion 16*c* is configured to associate with the golf club 48 such that the striking face of the golf club 48 is located in a plane P2 (see, e.g., FIGS. 1(E) and 1(F)). An imaginary plane P4 is perpendicular to the base plane 26 and perpendicular to the plane P2. The loft angle indicator 16*e* indicates the angular position of the pivoting portion 16*c* relative to the base plane 26. In alternative aspects of the present invention, the clamp 16 may be configured to secure the club head 48 at only a fixed loft angle relative to the base plane 26.

The base 14 may be formed from steel, aluminum, composite materials, polymeric materials, wood, a combination thereof, or any other suitable material. Preferably, the combined weight of the base 14, the angular-displacement gauge 18, the clamp 16, the actuator mounts 22 and 24, and the actuator 20 is less than or equal to about 100 lbs. More preferably, the combined weight of the base 14, the angular-displacement gauge 18, the clamp 16, the actuator mounts 22 and 24, and the actuator 20 is less than or equal to about 75 lbs. Most preferably, the combined weight of the base 14, the angular-displacement gauge 18, the clamp 16, the actuator 20, and the actuator mounts 22 and 24 is less than or equal to about 50 lbs.

Referring once again to FIG. 1(B), the angular-displacement gauge 18 is shown with the apparatus 10 in the first operating position. The angular-displacement gauge 18 is coupled to the base 14 at a first mounting point and includes a rotating portion 18*a*, a digital display 18*b*, and a magnetic portion 18*c*. The angular-displacement gauge 18 is slidably coupled to the base 14. The rotating portion 18*a* pivots to align with the shaft 49 of the golf club 48. The rotating portion 18*a* is configured to associate with the shaft 49 in a plane P1. An imaginary plane P3 is perpendicular to the base plane 26 and perpendicular to the plane P1 (see, e.g., FIGS. 1(E) and 1(F)). The apparatus 10 is preferably configured such that, when the apparatus 10 is in the first operating position, planes P3 and P4 are perpendicular, and, when the apparatus 10 is in the second operating position (see, e.g., FIGS. 1(G) and 1(H)), the planes P3 and P4 are parallel.

A sensor (not shown) associated with the rotating portion 18*a* detects an angular displacement of the rotating portion 18*a* relative to the base plane 26. The display 18*b* displays a value corresponding to the detected angular displacement, which may be associated with the lie angle of the club head 48. In one or more alternative aspects of the present invention, the angular-displacement gauge 18 may be an analog-type angular-displacement gauge.

In one or more aspects of the present invention, the display 18*b* may be configured to be calibrated. Specifically, the display may include a user-engageable button, switch, or the like, for "zero-ing" the angular reading of the display 18*b* in an angular position selected by the user. Calibration enables the user to maintain the accuracy of the angular-displacement gauge 18 as the apparatus 10 wears or otherwise structurally alters in a manner that would generate an inaccurate reading. Alternatively, the display 18*b* may be "zero-ed" if the user desires the displayed angular value to be based on a reference plane other than the base plane 26. For example, the user may desire to "zero" the angular-displacement gauge 18 in a position corresponding to a desired post-adjustment position. In this case, the displayed angular value, during the adjustment operation, would correspond to an angular offset from the desired final position.

In one or more aspects of the present invention, the angular-displacement gauge 18 includes a magnetic portion 18*c* to ensure that the rotating portion 18*a* flushly engages with the shaft 49. If the rotating portion 18*a* remains flush with the shaft 49 during operation, and if the angular-displacement gauge is slidably associated with the base 14, then the display 18*b* may continuously, or periodically, display a detected lie angle value during a club head adjustment, without user intervention.

Figure 1C:
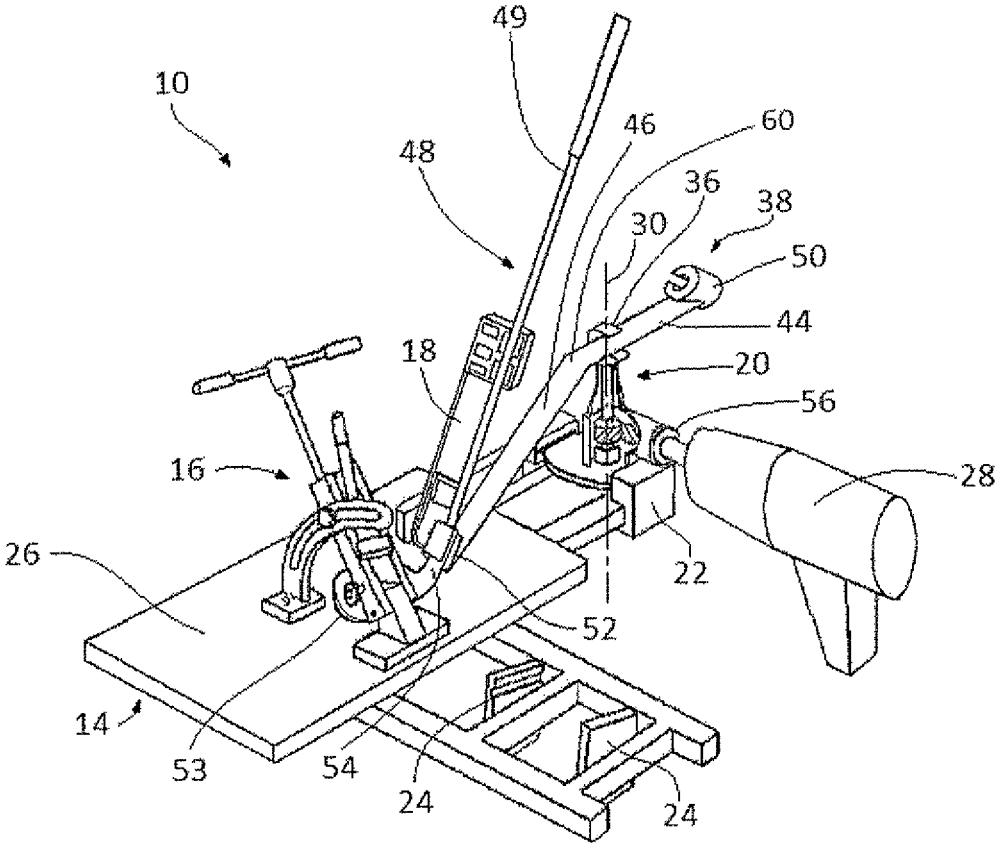
FIG. 1(C) is a front perspective view of the portion shown in FIG. 1(B) showing a cut-away view of an actuator, in a first operating position, according to one or more aspects of the present invention.
Figure 1D:
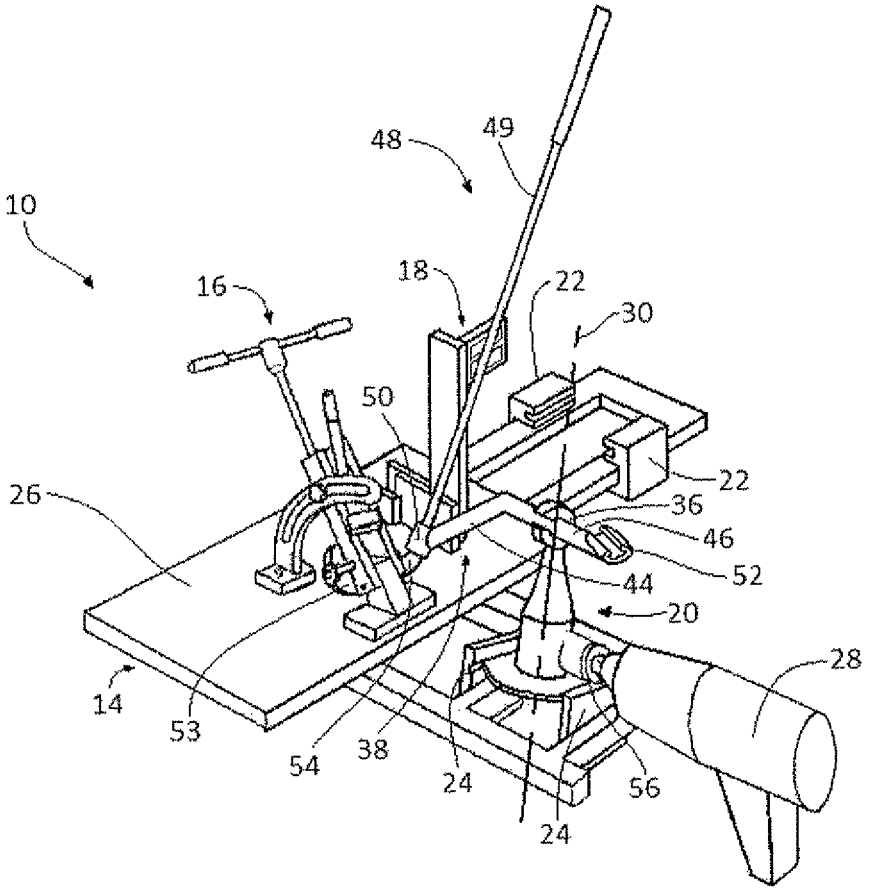
FIG. 1(D) is a front perspective view of a portion of the exemplary apparatus of FIG. 1(A), in a second operating position, according to one or more aspects of the present invention.
Figure 1E:
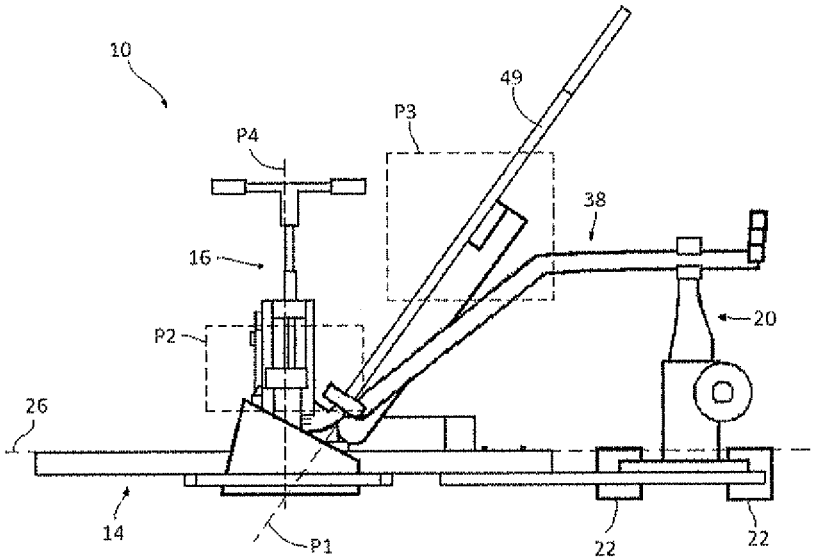
FIG. 1(E) is a front elevation view of the portion of the exemplary apparatus shown in FIG. 1(D), in a first operating position, according to one or more aspects of the present invention.
Figure 1F:
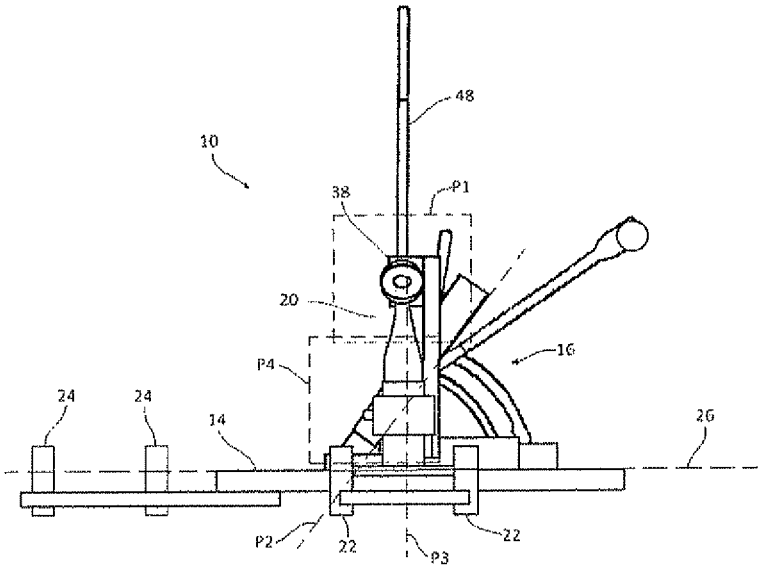
FIG. 1(F) is a right-side elevation view of the portion of the exemplary apparatus of FIG. 1(D), in a first operating position, according to one or more aspects of the present invention.
Figure 1G:
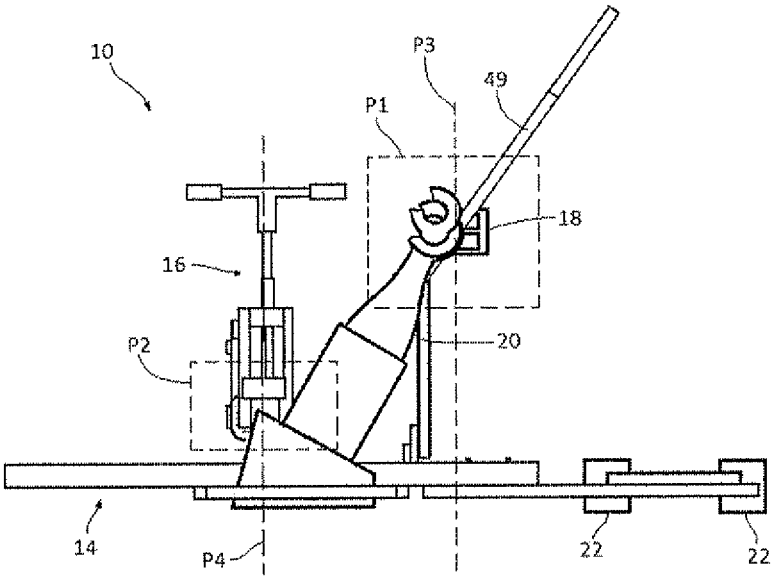
FIG. 1(G) is a front elevation view of the portion of the exemplary apparatus of FIG. 1(E), in a second operating position, according to one or more aspects of the present invention.
Figure 1H:
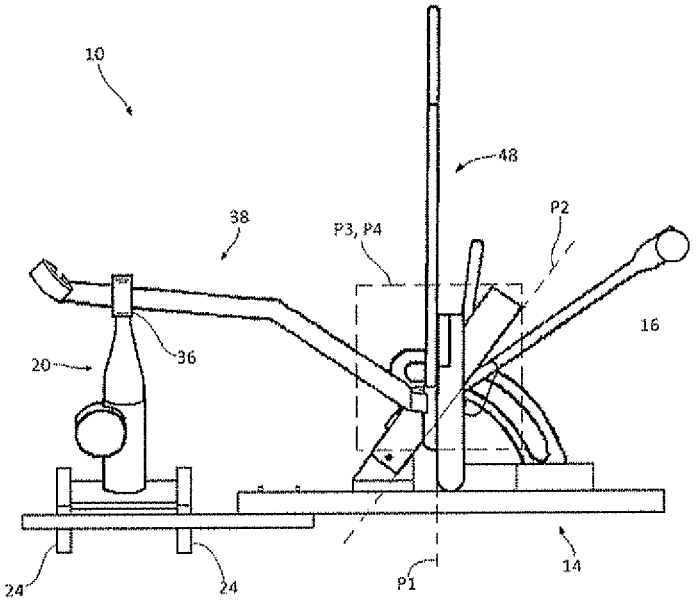
FIG. 1(H) is a right-side elevation view of the portion of the exemplary apparatus of FIG. 1(E), in a second operating position, according to one or more aspects of the present invention.

In one or more aspects of the present invention, the angular-displacement gauge 18 is removable from the first position and securable to the base 14 in the second position (see, e.g., FIG. 1(D)). In the second position, the angular-displacement gauge 18 is coupled to the base 14 at a second mounting point and may flushly and slidably engage with the shaft 49 of the club head 48. In this configuration, the angular-displacement gauge 18 is suited to continuously, or periodically, detect and display variation in loft angle as a user adjusts the loft angle of the golf club 48.

In one or more aspects of the present invention, the angular-displacement gauge includes a fastener (not shown), e.g., a hinged bracket, for slidably engaging with the shaft 49 of the club head 48. A fastener may enable more precise engagement between the angular-adjustment gauge 18 and the shaft 49. Further, the fastener enables slidable and flush engagement between the angular-displacement gauge 18 and the shaft 49 where the shaft is substantially non-ferrous (e.g., a graphite shaft).

Having multiple angular-displacement gauge 18 operating positions enables the apparatus 10 to perform multiple adjustment operations, e.g., adjustment of loft angle and lie angle, with a single compact angular-displacement gauge 18. Specifically, enabling the angular-displacement gauge 18 to be coupled to the base 14 in one of a plurality of orientations reduces the number of degrees of freedom otherwise required in conducting measurements of loft angle and lie angle. Thus, bulkiness of the apparatus 10 is further reduced. Nonetheless, in alternative aspects of the present invention, e.g., in the exemplary apparatus shown in FIG. 24, the angular-displacement gauge 18 may be configured to measure both the loft angle and the lie angle of the golf club 48 associated with the clamp 16, while coupled to the base 14 in a single mounting position.

In one or more aspects of the present invention, additional angular-displacement gauge operating positions may be enabled by configuring the base 14 to include additional angular-displacement gauge mounting points. For example, a third and fourth mounting point may be provided, e.g., for measuring the loft angle and the lie angle, respectively, of a left-handed type golf club head, as discussed below with regard to the aspect of the present invention shown in FIG. 16.

As shown in FIGS. 1(A), 1(B), and 1(C), the apparatus 10 is in the first operating position, thereby enabling a user to measure and adjust the lie angle of a secured golf club. Specifically, the actuator 20 is coupled to the actuator mount 22, which is coupled to the base 14. The actuator mount 22 includes a slotted configuration. The base of the actuator 20 has a complementary configuration for slidably engaging with the slotted configuration of the actuator mount 22. Preferably, the actuator mount 22 is configured such that, when the actuator 20 is coupled to the actuator mount 22, and when the golf club 48 is secured to the base 12 such that the scorelines of the club head 48 are parallel to the base plane 26 and the loft angle indicator 16*e* indicates the actual loft of the club head 48, the actuation axis 30 and the shaft axis 51 are substantially coplanar. Specifically, in an imaginary plane perpendicular to the base plane 26 that includes the actuation axis 30, the actuation axis 30 forms an angle with the base plane 26 between 75 and 105 degrees. More preferably, in an imaginary vertical plane including the actuation axis 30, the actuation axis 30 forms an angle with the base plane 26 between 85 and 95 degrees. Most preferably, in an imaginary vertical plane including the actuation axis 30, the actuation axis 30 is substantially perpendicular to the base plane 26. In one or more aspects of the present invention, the actuator mount 22 may include a translational adjustment device for adjusting the translational position of the actuator 20. For example, the translational adjustment device may be used to align the actuation axis 30 to be coplanar with a shaft axis of a secured club head that includes an offset hosel.

As shown in FIG. 1(D), the actuator 20 is removably coupled to the base 14 with the apparatus 10 in the second operating position, thereby enabling a user to measure and adjust the loft angle of a secured golf club. Specifically, the actuator 20 is coupled to the actuator mount 24, which is coupled to the base 14. The actuator mount 24 includes a slotted configuration. The base of the actuator 20 has a complementary configuration for slidably engaging with the slotted configuration of the actuator mount 24. Preferably, the actuator mount 24 is configured such that, when the actuator 20 is coupled to the actuator mount 24, and when the golf club 48 is secured to the base 14, the actuation axis 30 and the shaft axis 51 are substantially coplanar. Specifically, in an imaginary plane perpendicular to the base plane 26 that includes the actuation axis 30, the actuation axis 30 forms an angle with the base plane 26 between about 45 and about 75 degrees. More preferably, in an imaginary plane perpendicular to the base plane 26 that includes the actuation axis 30, the actuation axis 30 forms an angle with the base plane 26 between about 55 and about 65 degrees. Most preferably, in an imaginary plane perpendicular to the base plane 26 that includes the actuation axis 30, the actuation axis 30 forms an angle with the base plane 26 of substantially 62 degrees. In one or more aspects of the present invention, the actuator mount 24 may include a translational adjustment device for adjusting the translational position of the actuator 20.

In one or more aspects of the present invention, the actuator 20 may be further secured to either of the actuator mounts 22 and 24 by screw means, a clamp, an adhesive, a magnetic element, or the like.

Referring particularly to FIG. 1(C), the actuator 20 includes an output engagement portion 36 and an input engagement portion 56. The actuator 20 is a screw jack type actuator. Specifically, the actuator is configured such that rotational motion of the input engagement portion 56 by a driver 28 is converted to linear motion of the output engagement portion 36 by a gearing mechanism. In other aspects of the present invention, the actuator 20 may include a hydraulic RAM type actuator, a pneumatic actuator, a piezo-electric actuator, or any other suitable actuator. Preferably, the mechanical advantage of the actuator 20 is greater than 1, such that an output force of the output engagement portion 36 is greater than an input force of the input engagement portion 56 applied by the driver 28.

Referring again to FIG. 1(C), in one or more aspects of the present invention, the coupling 38 includes a first slotted head 50 at a first end and a second slotted head 52 at a second end. An elbow 60 is located intermediate the first slotted head 50 and the second slotted head 52. A first elongated portion 44 is formed between the elbow 60 and the first slotted head 50. A second elongated portion 46 is formed between the elbow 60 and the second slotted head 52. The slotted head 52 is removably coupled to the hosel 54 of the golf club 48. The elongated portion 44 is slidably engageable with the output engagement portion 36 of the actuator 20.

The form of the coupling 38 is not limited to the aspect shown in FIGS. 1(A)-1(D). Rather, the coupling 38 may be tailored to the specific geometric relationships between the various components of the apparatus 10. For example, the form of the coupling 38 may be based on the position of the actuator mounts 22 and 24 relative to the clamp 16 and/or the intended range of motion of the actuator 20. Also, the coupling 38 may conform to the intended type or size of golf club to be adjusted, or the type of adjustment to be made. For example, the slotted heads 50 and 52 may be configured to correspond to a specific hosel outer diameter and hosel length of a golf club intended to be adjusted, or respective ranges thereof. Alternative aspects of the coupling 38 are discussed below in further detail.

As shown in FIG. 1(A), the apparatus 10 may be associated with a movable cart 12. This is advantageous in permitting the apparatus 10 to be easily transported, e.g., from club-fitting facilities to outdoor locations, specific locations for club-fitting events, and the like. The cart 12 may be collapsible to reduce bulkiness and increase transportability.

To adjust the loft angle of the golf club 48, a user configures the apparatus 10 to be in the second operating position (FIG. 1(D)). Specifically, the angular-displacement gauge 18 is coupled to the base 14 and the actuator 20 is coupled the actuator mount 24. The user then secures the golf club 48 to the clamp 16. Preferably, the golf club 48 is coupled to the clamp 16 such that the striking face of the club head 53 is flush against the pivoting portion 16*c* of the clamp 16 and the scorelines of the golf club 48 are parallel to the base plane 26. The clamp 16 is pivoted about the axis $a_1$ (see FIG. 1(A)) and locked into place such that the loft angle indicator 16*e* corresponds to a desired post-adjustment loft angle. The angular-displacement gauge 18 is positioned to be flush against the shaft 49 of the golf club 48. In configuring the apparatus from the first operating position (FIGS. 1(A)-1(C)) to the second operating position (FIG. 1(D)), the orientation of the coupling 38 is reversed such that slotted head 50 engages with the hosel 54 of the golf club 48. The second elongated portion 46 of the coupling 38 is slidably engaged with the output engagement portion 36 of the actuator 20. The user then engages a driver 28 with the input engagement portion 56 of the actuator 20 to provide a force to the actuator 20. The driver 28 may be a portable device such as a drill, pump, or motor. In some aspects of the present invention, the driver 28 is powered by DC current, e.g., by means of a battery supply. In another aspect of the present invention, the driver 28 is powered by AC current. In some aspects of the present invention, the driver 28 may be fixedly associated with the apparatus 10. In some aspects of the present invention, the driver 28 may include a hand crank or other suitable hand-powered device. The force applied by the driver 28 results in linear motion of the output engagement portion 36 along the actuation axis 30, which, in turn, results in a moment applied to the coupling 38. The moment applied to the coupling 38 results in deformation of the hosel 54 of the club head 48.

As the hosel deforms, the rotating portion 18*a* of the angular-displacement gauge 18 pivots based on the movement of the shaft 49. The angular value displayed by the display 18*b* changes to reflect the change in angular position of the rotating portion 18*a*. When the display 18*b* indicates the desired post-adjustment value, the user stops operating the driver 28. The adjustment operation may need to be repeated and/or the user may need to adjust the hosel beyond a desired post-adjustment value, due to spring-back or similar material properties of the club head. "Spring-back," as used herein, denotes the ratio of an amount of displacement of a portion of a golf club under a specific stress to the permanent deformation that ultimately results from the stressing event. Once the display 18*b* displays the desired post-adjustment value when the hosel is in a non-stressed state, the loft adjustment operation is complete.

To adjust the lie angle of the golf club 48, a user configures the apparatus 10 to be in the first operating position (FIG. 1(B)). Specifically, the angular-displacement gauge 18 is coupled to the base 14 and the actuator 20 is coupled the actuator mount 22. The pivoting portion 16*c* of the clamp 16 is pivoted about the axis a1 (see FIG. 1(A)) and locked into place such that the loft angle indicator 16*e* corresponds to the actual loft angle of the club head 48. If the actual loft of the golf club 48 is not known, the loft may be determined by positioning the angular-displacement gauge 18 in the second mounting point (see, e.g., FIG. 1(D)) and flush against the shaft 49, and rotating the pivoting portion 16*c* of the clamp 16 until the angular-displacement gauge 18 indicates that that shaft axis 51 is perpendicular to the base plane 26. The reading on the loft angle indicator 16*e* corresponds to the actual loft angle of the club head 48.

Once the club head 48 is secured in the clamp 16 such that the loft angle indicator 16*e* indicates a value corresponding to the actual loft angle of the club head 48 and the angular-displacement gauge 18 is in the first operating position, the angular-displacement gauge 18 is positioned to be flush against the shaft 49 of the golf club 48. The second slotted head 52 of the coupling 38 is then coupled to the hosel 54 of the golf club 48. The first elongated portion 44 of the coupling 38 is slidably engaged with the output engagement portion 36 of the actuator 20. The user then engages the driver 28 with the input engagement portion 56 of the actuator 20 to provide a force to the actuator 20. The force applied by the driver 28 results in linear motion of the output engagement portion 36 along the actuation axis 30, which, in turn, results in a moment applied to the coupling 38. The moment applied to the coupling 38 results in deformation of the hosel 54 of the club head 48.

As the hosel deforms, the rotating portion 18*a* of the angular-displacement gauge 18 pivots based on the movement of the shaft 49. The angular value displayed by the display 18*b* changes to reflect the change in angular position of the rotating portion 18*a*. When the display 18*b* indicates the desired post-adjustment value, the user stops operating the driver 28. The adjustment operation may need to be repeated and/or the user may need to adjust the hosel beyond a desired post-adjustment value, due to spring-back or similar material properties of the club head. Once the display 18*b* displays the desired post-adjustment value when the hosel is in a non-stressed state, the lie adjustment operation is complete.

In one or more aspects of the present invention, the apparatus 10 may include a kit that includes some or all of the components discussed above for assembly by a user. In some aspects of the present invention, the kit includes some of the components discussed above, where the components are configured to associate with equipment that a user may already have. For example, in one or more aspects of the present invention, a kit includes the angular-displacement gauge 18, the actuator mounts 22 and 24, the actuator 20, and the movable cart 12, and is configured to be coupled to a user's golf club clamp and associated base. In one or more aspects of the present invention, a kit includes the angular-displacement gauge 18, the clamp 16, the actuator mounts 22 and 24, and the actuator 20, and is configured to be coupled to a user's stationary work bench or movable cart. In one or more aspects of the present invention, a kit includes any other sub-combination of components discussed above with regard to the apparatus 10.

FIGS. 2-11, 14 and 15 variously illustrate exemplary aspects of the coupling 38 for implementation with the apparatus 10. One of ordinary skill would appreciate that additional aspects that are not illustrated may also be within the scope of the present invention.

Figure 2:
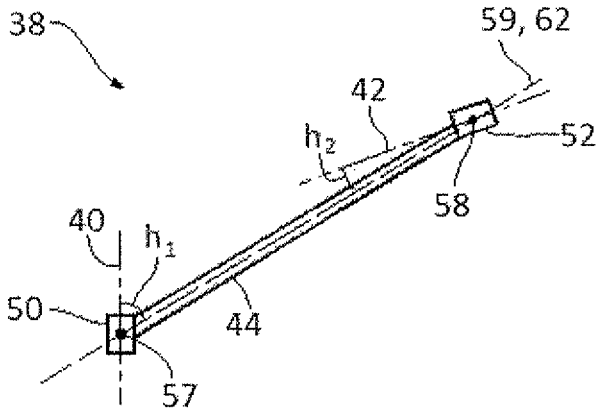
FIG. 2 is a right-side elevation view of an exemplary coupling according to one or more aspects of the present invention.
Figure 3:
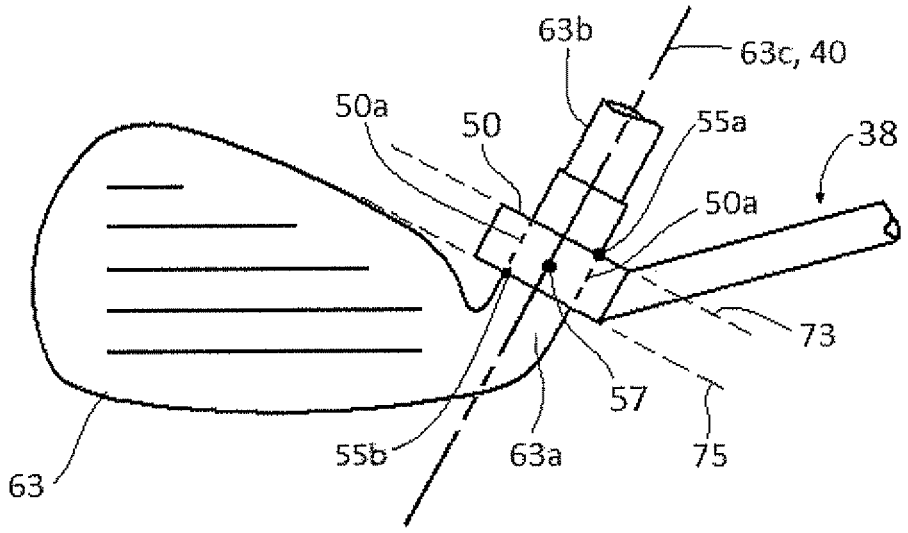
FIG. 3 is a front elevation view of a detail of the exemplary coupling of FIG. 2 engaged with a golf club, according to one or more aspects of the present invention.

Referring to FIGS. 2 and 3, in one or more aspects of the present invention, a coupling 38 is shown having an elongated portion 44. The elongated portion 44 is intermediate slotted heads 50 and 52. The slotted head 50 includes a contact surface 50*a*. The slotted head 52 also includes a contact surface that is not shown. The contact surface denotes the aggregate surface region, on the surface of the slotted head that, when the slotted head is engaged with a hosel of a golf club, in an operating state, contacts the hosel of the golf club, for each and every hypothetical cylindrical hosel ranging from a hosel having an infinitesimal outer diameter to a hosel having an outer diameter sized such that no play exists between the hosel and the slotted head. The contact surface includes a shaft-ward most extent 55*a* and a sole-ward most extent 55*b* relative to the head axis.

Referring to FIG. 3, in one or more aspects of the present invention, an imaginary golf club 63 includes an imaginary hosel portion 63*a* and an imaginary shaft 63*b* having an imaginary shaft axis 63*c*. "Head axis," e.g. head axis 40, as referred to herein, denotes the axis of a slotted head 50 that, if the slotted head 50 is coupled to the imaginary hosel 63*a* without any play between the imaginary hosel 63*a* and the contact surface 50*a* of the slotted head 50, coincides with the imaginary shaft axis 63*c*. The slotted head 52 also includes a head axis 42 when the slotted head 52 is coupled to the imaginary hosel 63*a*.

Referring again to FIG. 3, "center point," e.g., center point 57, as referred to herein, denotes an imaginary point located on the head axis 40 of the slotted head 50 equidistant between a first imaginary plane 73, perpendicular to the head axis 40 and passing through the shaft-ward most extent 55*a*, and a second imaginary plane 75, perpendicular to the head axis 40 and passing through the sole-ward most extent 55*b*. The slotted head 50 has a first center point 57 and ther slotted head 52 has a second center point 58.

Referring again to FIG. 2, an imaginary center line 59 corresponds to an imaginary line passing through the first center point 57 and the second center point 58. The head axis 40 and the center line 59 form, e.g., an angle $h_1$. The head axis 42 and the center line 59 form, e.g., an angle $h_2$. Preferably, $h_1$ is between 20 and 70 degrees. More preferably, $h_1$ is between 35 and 55 degrees. Even more preferably, $h_1$ is between 40 and 50 degrees. Most preferably, $h_1$ is substantially equal to about 45 degrees. These ranges provide that, when adjusting the loft angle of the golf club 48 by engaging the coupling 38 with the golf club head 48 and the actuator 20 in the second operating position (see FIG. 1(D)), the elongated portion 44 is favorably positioned and the output engagement portion 36 operates within an optimal range of motion, reducing bulkiness.

Preferably, $h_2$ is between 5 and 45 degrees. More preferably, $h_2$ is between 10 and 30 degrees. Even more preferably, $h_2$ is between 10 and 20 degrees. Most preferably, $h_2$ is substantially equal to about 15 degrees. These ranges provide that, when adjusting the lie angle of the golf club 48 by engaging the coupling 38 with the golf club head 48 and the actuator 20 in the first operating position (see FIG. 1(B)), the elongated portion 44 is favorably positioned and the output engagement portion 36 operates within an optimal range of motion, reducing bulkiness.

Regarding the relationship between $h_1$ and $h_2$, the coupling 38 is preferably configured such that $h_1$ is unequal to $h_2$. More preferably, the absolute difference between $h_1$ and $h_2$ is greater than or equal to 15 degrees. Even more preferably, the absolute difference between $h_1$ and $h_2$ is between 20 and 40 degrees. Even more preferably, the absolute difference between $h_1$ and $h_2$ is substantially equal to 30 degrees. These relationships ensure that the coupling 38 is adapted to associate with the hosel 54 of the golf club 48 in multiple positions for conducting multiple adjustment operations, without increasing the bulkiness of the apparatus 10 (see FIGS. 1(B) and 1(D)).

Figure 4:
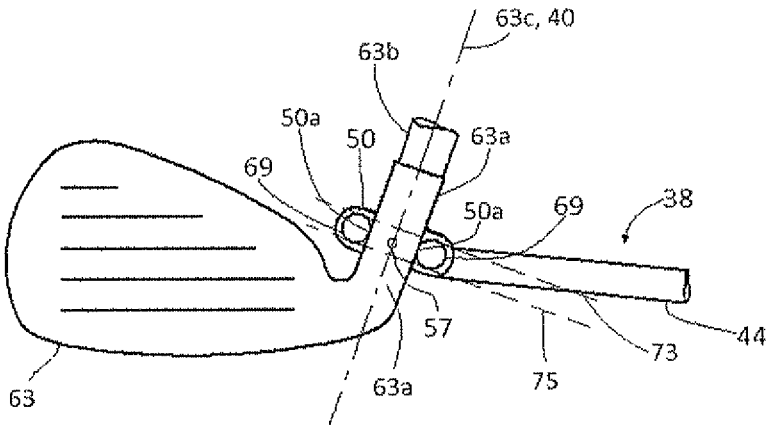
FIG. 4 is a right-side elevation view of a portion of an exemplary coupling engaged with a golf club, according to one or more aspects of the present invention.

Referring to FIG. 4, in one or more aspects of the present invention, a slotted head 50 comprises two extensions 69 for engaging with the imaginary hosel portion 63*a* of the imaginary golf club head 63. The head axis 40 is coincident with the imaginary shaft axis 63*c* of the imaginary golf club 63. The slotted head 50 further includes a center point 57, and the slotted head 52 includes a center point 58.

Figure 5:
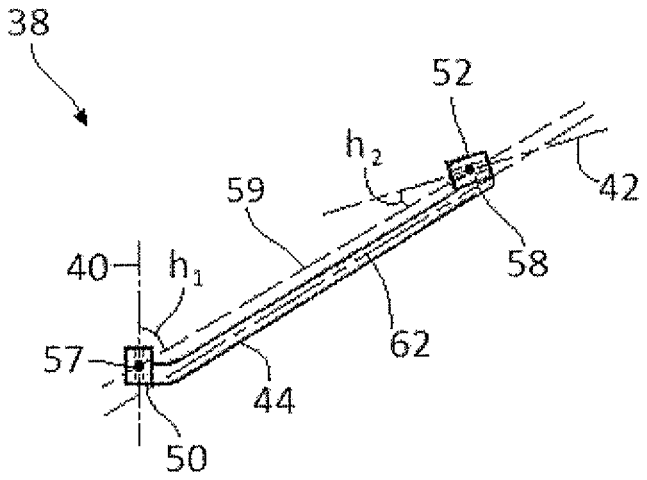
FIG. 5 is a right-side elevation view of an exemplary coupling according to one or more aspects of the present invention.

Referring to FIG. 5, in one or more aspects of the present invention, a coupling 38 includes slotted heads 50 and 52 and an elongated portion 44 intermediate the slotted heads 50 and 52. The slotted heads 50 and 52 each include head axes 40 and 42, respectively. The elongated portion 44 has an elongated portion axis 62. An imaginary center line 59 passes through center points 57 and 58. The head axis 40 and the center line 59 form an angle $h_1$. The head axis 42 and the center line 59 form an angle $h_2$.

As shown, center points 57 and 58 of respective slotted heads 50 and 52 are offset from the elongated portion axis 62. In some aspects of the present invention, the center points 57 and 58 of the slotted heads 50 and 52 are offset by a substantially equal distance from the elongated portion axis 62. In some aspects of the present invention, center points 57 and 58 may be offset by different distances from the elongated portion axis 62. In some aspects of the present invention, only one of center points 57 and 58 is offset from the elongated portion axis 62, while the other is collinear with the elongated portion axis 62. Angles $h_1$ and $h_2$ preferably satisfy the relationships discussed above with regard to the exemplary coupling of the present invention shown in FIG. 2.

Figure 6A:
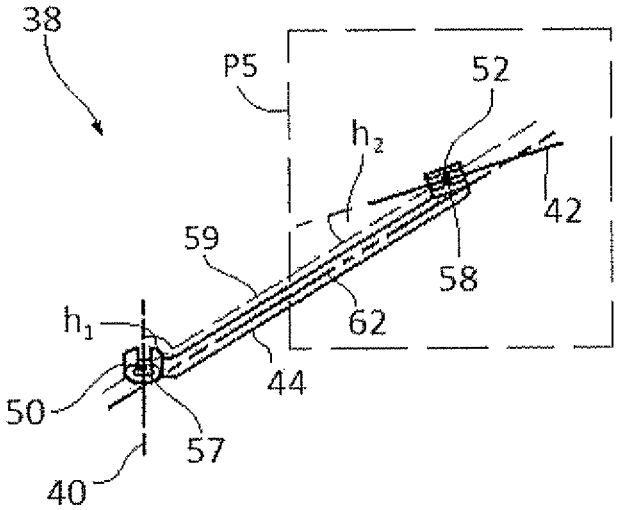
FIG. 6(A) is a right-side elevation view of an exemplary coupling according to one or more aspects of the present invention.
Figure 6B:
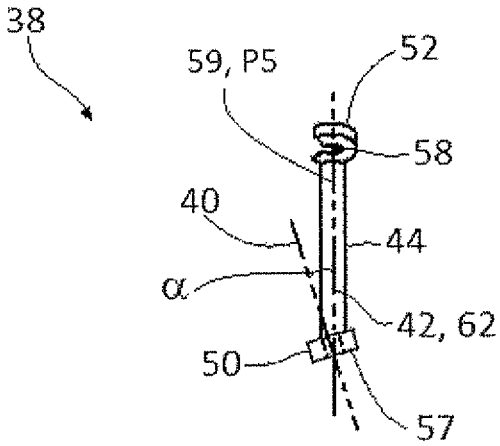
FIG. 6(B) is a front elevation view of the exemplary coupling of FIG. 6(A), according to one or more aspects of the present invention.

Referring to FIGS. 6(A) and 6(B), in one or more aspects of the present invention, a coupling 38 includes slotted heads 50 and 52 and an elongated portion 44 intermediate the slotted heads 50 and 52. The slotted heads 50 and 52 each include head axes 40 and 42, respectively. The elongated portion 44 has an elongated portion axis 62. An imaginary center line 59 passes through center points 57 and 58. The head axis 40 and the center line 59 form an angle $h_1$. The head axis 42 and the center line 59 form an angle $h_2$. The head axis 42 and the center line 59 are located in an imaginary plane P5. The head axis 40 is non-coplanar with the imaginary plane P5. Rather, the head axis 40 is offset from the imaginary plane by an angle $\alpha$ of about 30 degrees. Specific advantages may be recognized by configuring the coupling 38 such that the head axis 40 is angularly offset. For example, in the second operating position (see, e.g., FIG. 1(D)), the coupling 38 may engage with the hosel 54 of the golf club head 53 at an oblique angle with respect to the base plane 26, while the actuator 20 actuates in an actuation axis 30 that is substantially perpendicular to the base plane 26 (not shown). In this manner, the structure of the actuator mount 24 may be simplified, reducing bulkiness. In some aspects of the present invention, both the head axis 40 may be non-coplanar with the center line 59 and the head axis 42 may be non-coplanar with the centerline 59.

Figure 7:
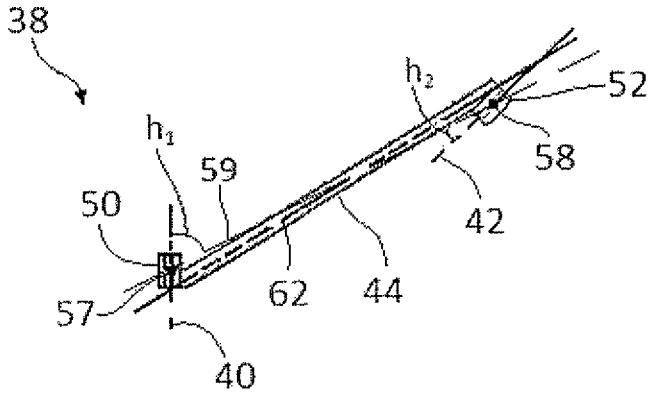
FIG. 7 is a right-side elevation view of an exemplary coupling according to one or more aspects of the present invention.

Referring to FIG. 7, in one or more aspects of the present invention, a coupling 38 includes slotted heads 50 and 52 and an elongated portion 44 intermediate the slotted heads 50 and 52. The slotted head 50 includes a center point 57 and a head axis 40. The slotted head 52 includes a center point 58 and a head axis 42. An imaginary center line 59 passes through the center points 57 and 58. The head axis 40 and the center line 59 form an angle $h_1$. The center line 59 and the head axis 42 forms an angle $h_2$. The center points 57 and 58 are both translationally offset from the elongated portion axis 62. The slotted heads 50 and 52 are radially offset from each other relative the elongated portion axis 62. Specifically, the center point 58 is diametrically opposed to the center point 57 relative the elongated portion axis 62. Angles $h_1$ and $h_2$ preferably satisfy the relationships discussed above with regard to the exemplary coupling shown in FIG. 2.

Figure 8:
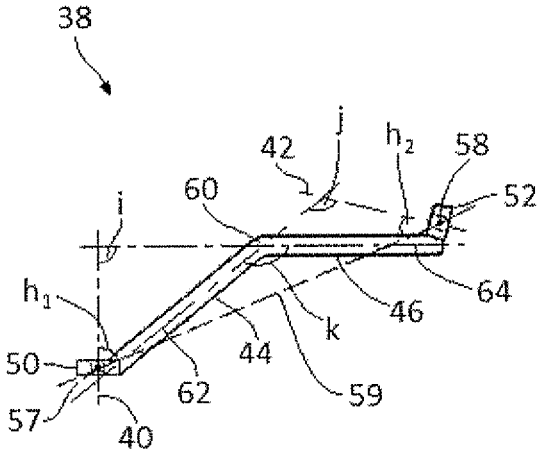
FIG. 8 is a right-side elevation view of an exemplary coupling according to one or more aspects of the present invention.

Referring to FIG. 8, in one or more aspects of the present invention, a coupling 38 includes slotted heads 50 and 52 and elongated portions 44 and 46 intermediate the slotted heads 50 and 52. The slotted head 50 include a head axis 40 and a center point 57. The slotted head 52 includes a head axis 42 and a center point 58. An imaginary center line 59 passes through the center points 57 and 58. An angle $h_1$ is formed between the head axis 40 and the center line 59. An angle $h_2$ is formed between the head axis 42 and the center line 59. An elbow 60 is located between the elongated portions 44 and 46.

The elongated portion 44 includes an elongated portion axis 62. The elongated portion 46 includes an elongated portion axis 64. The head axis 40 and the elongated portion axis 64 form and angle i. The head axis 42 and the elongated portion axis 62 form an angle j. The elongated portion axis 62 and the elongated portion axis 64 form an angle k. The slotted head 50 is configured to associate with the hosel 54 of the golf club head 53 when the apparatus 10 is in the second operating position (see, e.g., FIG. 1(D)). The slotted head 52 is configured to associate with the hosel 54 of golf club head 53 when the apparatus 10 is in the first operating position (see, e.g., FIG. 1(B)). Specifically, when the apparatus 10 is in the second operating position, the elongated portion 46 slidably associates with the output engagement portion 36 of actuator 20. Likewise, when the apparatus 10 is in the first operating position, the elongated portion 44 slidably associates with the output engagement portion 36 of actuator 20.

Angle $h_1$ preferably is between about 45 and about 85 degrees. More preferably, $h_1$ is between about 55 and about 75 degrees. Even more preferably, $h_1$ is between about 60 and about 70 degrees. Most preferably, $h_1$ is equal to about 68 degrees. Angle $h_2$ is preferably between about 20 and about 65 degrees. More preferably, $h_2$ is between about 30 and about 55 degrees. Even more preferably, $h_2$ is between about 35 and about 45 degrees. Most preferably, $h_2$ is equal to about 38 degrees. Regarding the relationship between $h_1$ and $h_2$, preferably, $h_1$ and $h_2$ are unequal. More preferably, the absolute difference between $h_1$ and $h_2$ is greater than about 10 degrees. Even more preferably, the absolute difference between $h_1$ and $h_2$ is greater than or equal to about 20 degrees. Even more preferably, the absolute difference between $h_1$ and $h_2$ is between about 25 and 35 degrees. Most preferably, the absolute difference between $h_1$ and $h_2$ is equal to about 30 degrees. These ranges ensure that the apparatus 10 is capable of conducting multiple distinct golf club adjustments, while maintaining a generally compact configuration. Angle i is preferably between about 70 and about 110 degrees. More preferably, angle i is between about 80 and about 100 degrees. Even more preferably, angle i is between 85 and 95 degrees. Most preferably, angle i is equal to about 90 degrees. Angle j is preferably between about 100 and 140 degrees. More preferably, angle j is between about 110 and about 130 degrees. Even more preferably, angle j is between about 115 and about 125 degrees. Most preferably, angle j is equal to about 120 degrees. Angle k, preferably, is between about 120 and about 150 degrees. More preferably, k is between about 130 and about 140 degrees. Most preferably, k is equal to about 135 degrees. These ranges ensure that the apparatus 10 is capable of being configured in multiple discrete operating positions for performing multiple golf club adjustments while maintaining a generally compact configuration. Outside of these ranges, when the coupling 38 is associated with the apparatus 10, as shown for example in FIGS. 1(B) and 1(D), the range of motion of the output engagement portion 36 necessary for accommodating the coupling 38 in multiple operating positions would be unduly large and, thus, increase bulkiness and hinder portability.

Preferably, the elongated portions 44 and 46 are of substantially equal length. If the elongated portions 44 and 46 are of substantially equal length, the coupling 38 may be more suitably configured to associate with a single actuator 20, or multiple actuators of the same dimensions, at multiple discrete actuator mounts 22 and 24 that are equidistant from the hosel 54 of the golf club head 53. Specifically, the output engagement portion 36 of the actuator 20 may operate, in each of the first and second operating positions, within the same range of motion. As a result, the bulkiness of the actuator 20, and, thus, the apparatus 10 overall, may be reduced.

In alternative aspects of the present invention, the elongated portions 44 and 46 may differ in length. Such alternative aspects may be particularly advantageous if additional spatial constraints are imposed on the various components of the apparatus 10. For example, in some applications of the present invention, it may be considered advantageous if the base 14 of the apparatus 10 is longer than it is wide. In this case, to provide that the output engagement portion 36 of the actuator 20 operates within a specified range of motion, the actuator 20 may be associated with the base 14 in at least two positions that are not equidistant from the intended position of the hosel 54. To this end, the coupling 38 may include elongated portions 44 and 46 that are not of substantially the same length.

Figure 9A:
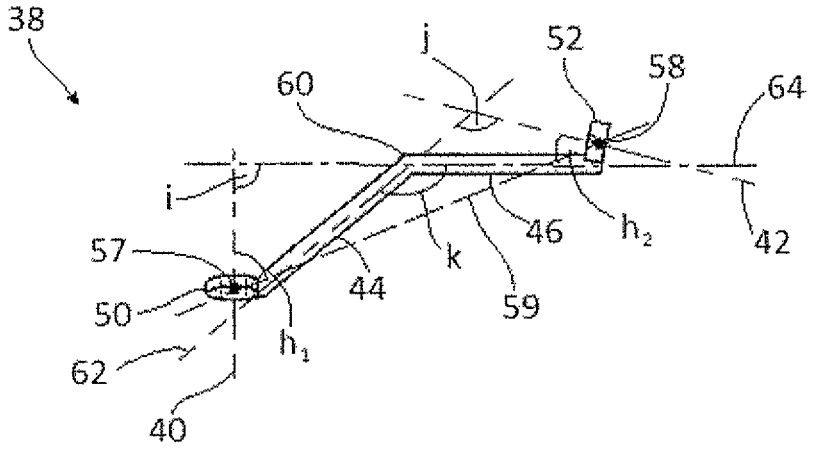
FIG. 9(A) is a right-side elevation view of an exemplary coupling according to one or more aspects of the present invention.
Figure 9B:
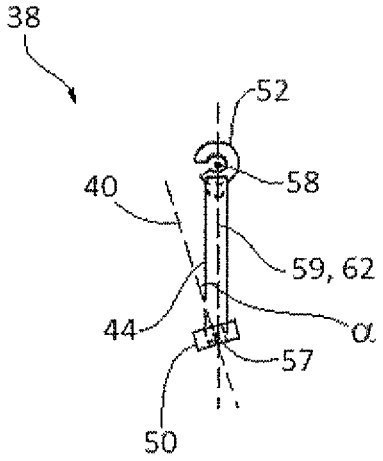
FIG. 9(B) is a front elevation view of the exemplary coupling of FIG. 9(A).

Referring to FIGS. 9(A) and 9(B), in one or more aspects of the present invention, a coupling 38 includes slotted heads 50 and 52 and elongated portions 44 and 46 intermediate the slotted heads 50 and 52. The slotted head 50 includes a head axis 40 and a center point 57. The slotted head 52 includes a head axis 42 and a center point 58. An elbow 60 is located intermediate the elongated portion 44 and the elongated portion 46. The elongated portion 44 includes an elongated portion axis 62. The elongated portion 46 includes an elongated portion axis 64. A center line 59 passes through center points 57 and 58. Angle $h_1$ is formed between the head axis 40 and the center line 59. Angle $h_2$ is formed between the head axis 42 and the center line 59.

Angle i corresponds to the angle formed between the head axis 40 and the elongated portion axis 64, projected in the plane formed by the center point 57 and the elongated portion axis 64. Angle j corresponds to the angle formed between the head axis 42 and the elongated portions axis 62. The head axis 40 is angularly offset from the plane containing the center point 57 and the elongated portion 46. Preferably, the head axis 40 is offset by an angle $\alpha$ of about 28 degrees. An angle k is formed between the elongated portion axis 62 and the elongated portion axis 64.

Preferably, angle i is between about 70 degrees and about 110 degrees. More preferably, angle i is between about 80 degrees and about 100 degrees. Most preferably, angle i is equal to about 90 degrees. Angle j is preferably between about 40 degrees and about 80 degrees. More preferably, angle j is between about 50 degrees and about 70 degrees. Most preferably, angle j is equal to about 60 degrees. Preferably, angle k is between about 120 and about 150 degrees. More preferably, k is between about 130 and about 140 degrees. Most preferably, k is substantially equal to 135 degrees. Angle $h_1$ is preferably between about 55 degrees and about 85 degrees. More preferably, $h_1$ is between about 65 degrees and about 75 degrees. Most preferably, $h_1$ is equal to about 69 degrees. Angle $h_2$ is preferably between about 20 degrees and about 60 degrees. More preferably, $h_2$ is between about 30 degrees and about 50 degrees. Most preferably, $h_2$ is equal to about 39 degrees.

Regarding the relationship between $h_1$ and $h_2$, $h_1$ and $h_2$ are preferably unequal. More preferably, the absolute difference between $h_1$ and $h_2$ is greater than or equal to about 10 degrees. Even more preferably, the absolute difference between $h_1$ and $h_2$ is between 20 and 40 degrees. Most preferably, the absolute difference between $h_1$ and $h_2$ is equal to about 30 degrees. These ranges ensure that the apparatus 10 is capable of being configured in multiple discrete operating positions for performing multiple golf club adjustments while maintaining a generally compact configuration.

Figure 10:
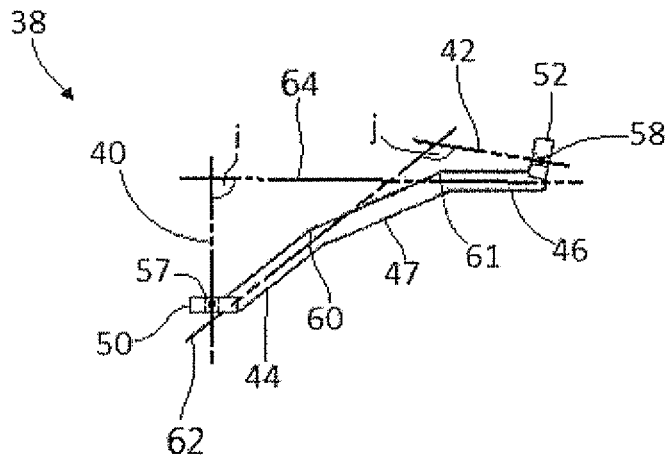
FIG. 10 is a right-side elevation view of an exemplary coupling according to one or more aspects of the present invention.

Referring to FIG. 10, in one or more aspects of the present invention, a coupling 38 includes slotted heads 50 and 52 and elongated portions 44, 46 and 47 intermediate the slotted heads 50 and 52. Slotted head 50 includes a head axis 40 and a center point 57. The slotted head 52 includes a head axis 42 and a center point 58. Elongated portion 44 includes an elongated portion axis 62. Elongated portion 46 includes an elongated portion 64. Elongated portion 47 includes an elongated portions axis (not shown). A first elbow 60 is formed intermediate the elongated portion 44 and the elongated portion 47. A second elbow 61 is formed intermediate the elongated portion 47 and the elongated portion 46.

Figure 11:
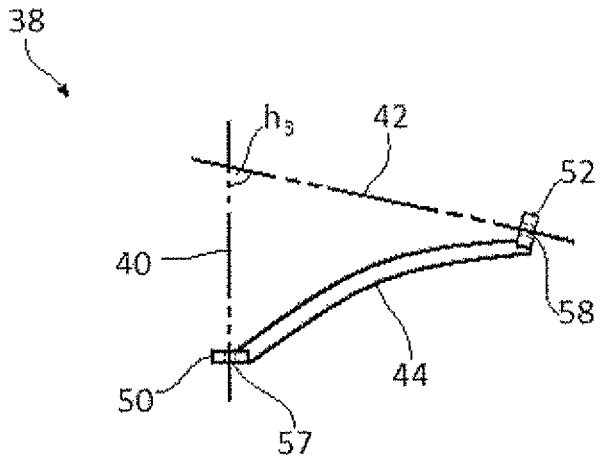
FIG. 11 is a right-side elevation view of an exemplary coupling according to one or more aspects of the present invention.

Referring to FIG. 11, in one or more aspects of the present invention, a coupling 38 may include slotted heads 50 and 52 and an elongated portion 44 intermediate the slotted heads 50 and 52. The slotted head 50 includes a head axis 40 and a center point 57. The slotted head 52 includes a head axis 42 and a center point 58. As shown, the center points 57 and 58 and the elongated portion 44 are generally coplanar with each other. Further, the elongated portion 44 is generally curvilinear.

In some aspects of the present invention, the elongated portion 44 is configured such that the elongated portion axis 62 has a substantially continuous radius of curvature. In other aspects of the present invention, the elongated portion 44 is configured such that the elongated portion axis 62 varies in radius of curvature. In some aspects of the present invention, the elongated portion 44 may include at least one inflection point. In some aspects of the present invention, the elongated portion 44 may follow a sinusoidal path.

Figure 12A:
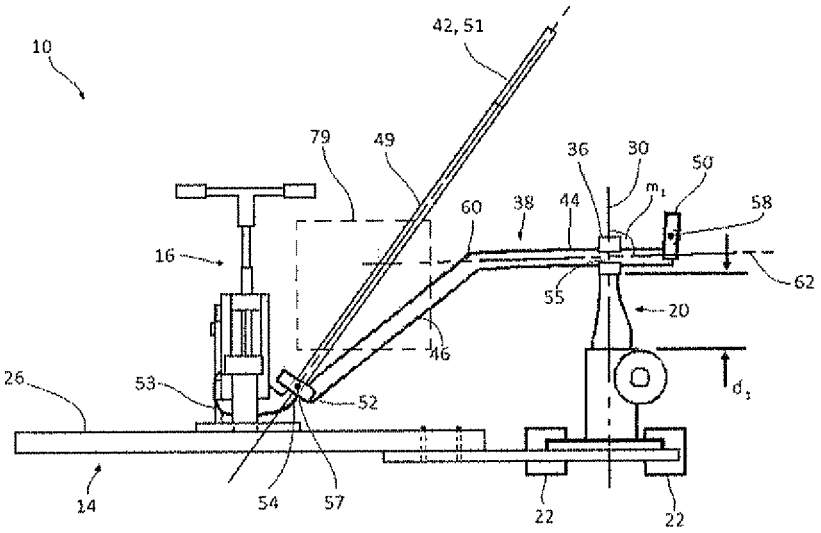
FIG. 12(A) is a front elevation view of a portion of the exemplary apparatus of FIG. 1(A), in the first operating position, according to one or more aspects of the present invention.
Figure 12B:
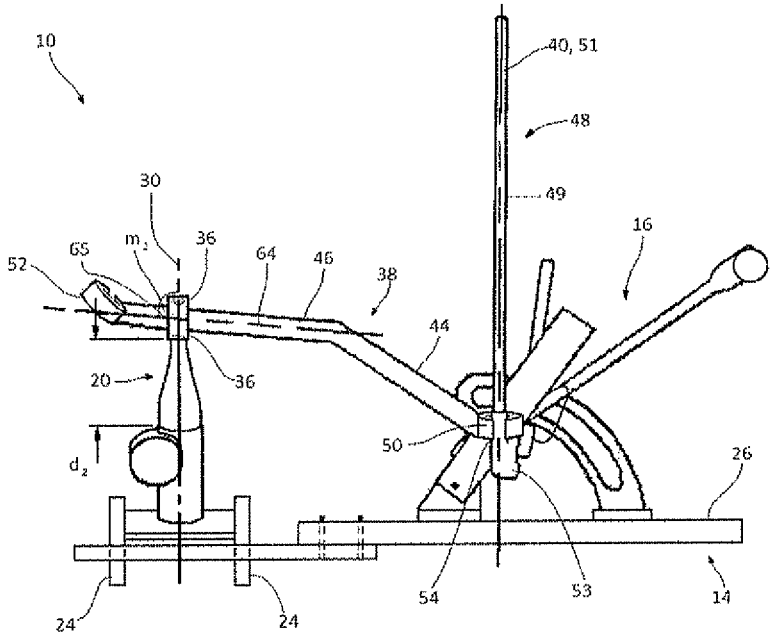
FIG. 12(B) is a right-side elevation view of a portion of the exemplary apparatus of FIG. 12(A), in the second operating position, according to one or more aspects of the present invention.

FIGS. 12(A)-12(B) further illustrate the relationship between the apparatus 10, the coupling 38, and the golf club 48 for which an adjustment is to be made. Specifically, FIG. 12(A) is a front elevation view of the apparatus 10 in the first operating position (see, e.g., FIG. 1(B)). FIG. 12(B) is a right-side elevation view of the apparatus 10 in the second operating position (see, e.g., FIG. 1(D)). As discussed above, in the first operating position, the apparatus 10 may be considered to be configured to adjust a lie angle of the golf club 48. In the second operating position, the apparatus 10 may be considered to be configured to adjust a loft angle of the golf club 48. A user may reconfigure the apparatus 10 from the first operating position to the second operating position, or vice versa, by relocating the actuator 20 between the actuator mounts 22 and 24, and by relocating the angular-displacement gauge 18 from the first mounting point to the second mounting point, as discussed above. The golf club 48 does not need to be relocated in reconfiguring the apparatus 10 from the first operating position to the second operating position. The coupling is of the type having a first elongated portion 44, a second elongated portion 46 of substantially equal length to the first elongated portion 44, and an elbow 60 intermediate the first elongated portion 44 and the second elongated portion 46.

Referring specifically to FIG. 12(A), the golf club 48 comprises a golf club head 53, a hosel 54, and a shaft 49. The shaft includes a shaft axis 51. The golf club 48 is secured to the clamp 16 such that the shaft 49 lies in an imaginary shaft plane 79 that is perpendicular to the base plane 26. In the imaginary shaft plane 79, the shaft axis 51 forms a shaft angle, relative to the base plane 26, that corresponds to the indicated lie angle of the golf club 48. The output engagement portion 36 of the actuator 20 is located at a distance $d_1$ from a rest position. The output engagement portion 36 is configured to move along an actuation axis 30.

Referring again to FIG. 12(A), the slotted head 52 of the coupling 38 associates with the hosel 54 of the golf club 48. The head axis 42 is collinear with the shaft axis 51. The elongated portion 44 engages with the output engagement portion 36 of the actuator 20 at the contact portion 55. Angle $m_1$ corresponds to the angle formed between the elongated portion axis 62, measured at the contact point 55, and the actuation axis 30.

Referring to FIG. 12(B), the orientation of coupling 38 is reversed such that the slotted head 50 is engaged with the hosel 54 of golf club head 53 and the elongated portion 46 is engaged with the output engagement portion 36 at a contact portion 65. The head axis 40 is collinear with the shaft axis 51 of the golf club 48. The output engagement portion 36 is at a distance $d_2$ from the rest position. Angle $m_2$ corresponds to the angle formed between the elongated portion axis 64, measured at the contact portion 65, and the actuation axis 30.

Referring to FIGS. 12(A) and 12(B), the apparatus 10 is preferably configured such that, if the golf club 48 is in the same position in each of the first operating position and the second operating position, and if $d_1$ equals $d_2$, then $m_1$ and $m_2$ are within 15 degrees of each other. More preferably, the apparatus 10 is configured such that, if the golf club 48 is in the same position in each of the first operating position and the second operating position, and if $d_1$ equals $d_2$, then $m_1$ and $m_2$ are within 10 degrees of each other. Even more preferably, the apparatus 10 is configured such that, if the golf club 48 is in the same position in each of the first operating position and the second operating position, and if $d_1$ equals $d_2$, then $m_1$ and $m_2$ are within 5 degrees of each other. Most preferably, the apparatus 10 is configured such that, if the golf club 48 is in the same position in each of the first operating position and the second operating position, and if $d_1$ equals $d_2$, then $m_1$ and $m_2$ are substantially equal.

Figure 13A:
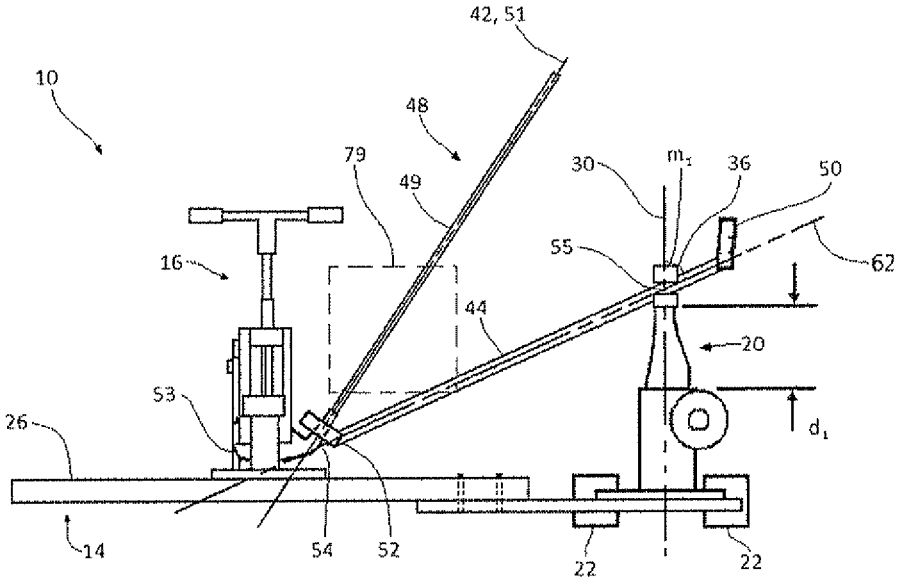
FIG. 13(A) is a front elevation view of a portion of the apparatus of FIG. 1(A), in the first operating position, according to one or more aspects of the present invention.
Figure 13B:
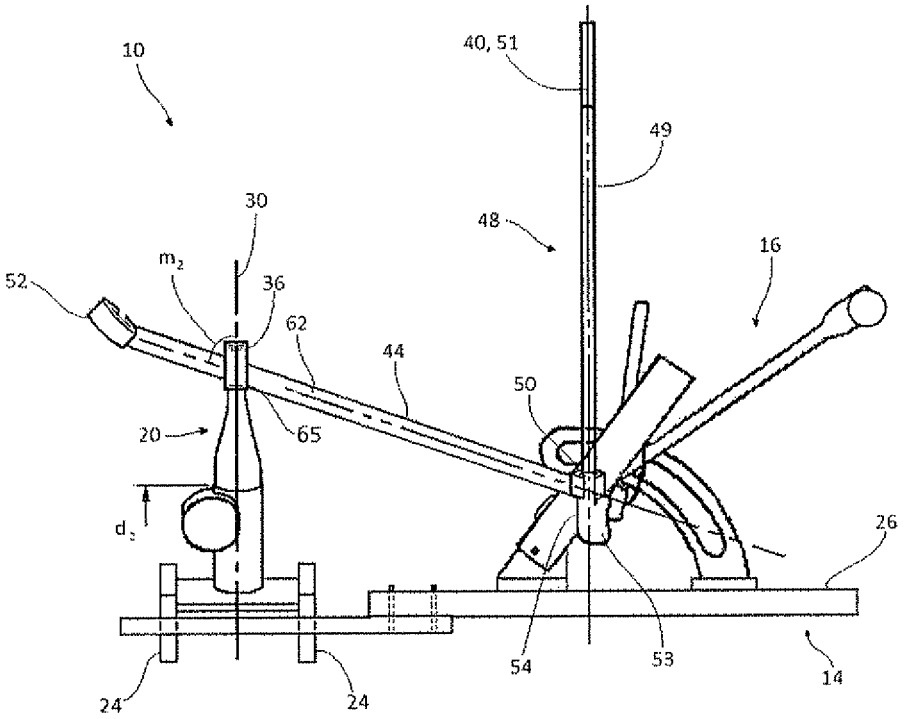
FIG. 13(B) is a right-side elevation view of the apparatus of FIG. 13(A), in the second operating position, according to one or more aspects of the present invention.

In one or more aspects of the present invention, FIGS. 13(A) and 13(B) further illustrate the relationship between the apparatus 10, the golf club 48, and a coupling 38 similar to the exemplary coupling 38 shown in FIG. 5. Specifically, FIG. 13(A) illustrates the apparatus 10 in the first operating position in front elevation view. FIG. 13(B) illustrates the apparatus 10 in the second operating position in right-side elevation view, Referring to FIG. 13(A), the elongated portion 44 of the coupling 38 is slidably engaged with the output engagement portion 36 of the actuator 20 at a contact portion 55. The slotted head 52 is coupled to the hosel 54 of the club head 48. Thus, the head axis 42 is generally collinear with the shaft axis 51. Angle $m_1$ corresponds to the angle formed between the elongated portion axis 62, measured at the contact portion 55, and the actuation axis 30. The output engagement portion 36 is at a distance $d_1$ from a rest position.

Referring to FIG. 13(B), in the second operating position, the elongated portion 44 of the coupling 38 is engaged with the output engagement portion 36 of actuator 20 at a contact portion 65. The slotted head 50 is coupled to the hosel 54 of the golf club 48. Thus, the head axis 40 is collinear with the shaft axis 51. Angle $m_2$ corresponds to the angle formed between the elongated portion axis 62, measured at the contact portion 65, and the actuation axis 30. The output engagement portion 36 is at a distance $d_2$ from the rest position.

Referring to FIGS. 13(A) and 13(B), the apparatus 10 is preferably configured such that, if the golf club 48 is in the same position in each of the first operating position and the second operating position, and if $d_1$ equals $d_2$, then $m_1$ and $m_2$ are within 15 degrees of each other. More preferably, the apparatus 10 is configured such that, if the golf club 48 is in the same position in each of the first operating position and the second operating position, and if $d_1$ equals $d_2$, then $m_1$ and $m_2$ are within 10 degrees of each other. Even more preferably, the apparatus 10 is configured such that, if the golf club 48 is in the same position in each of the first operating position and the second operating position, and if $d_1$ equals $d_2$, then $m_1$ and $m_2$ are within 5 degrees of each other. Most preferably, the apparatus 10 is configured such that, if the golf club 48 is the same position in each of the first operating position and the second operating position, and if $d_1$ equals $d_2$, then $m_1$ and $m_2$ are substantially equal. These ranges permit the apparatus 10 to be sufficiently compact for portable use. In addition, the above relationships between the coupling 38, the apparatus 10, and the golf club 48 extend to other aspects of the coupling 38 either shown or not shown in the Drawings.

Figure 14:
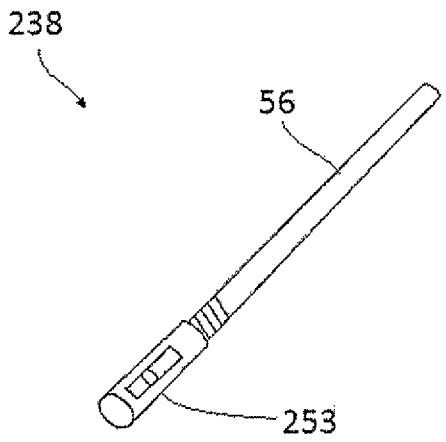
FIG. 14 is a front perspective view of an exemplary coupling according to one or more aspects of the present invention.

Referring to FIG. 14, in one or more aspects of the present invention, a coupling 238 includes an elongated portion 56 and an adjustable slotted head 253. Specifically, the inner diameter of the slotted head 253 may be adjusted to fit golf club heads of a variety of hosel outer diameters.

Figure 15:
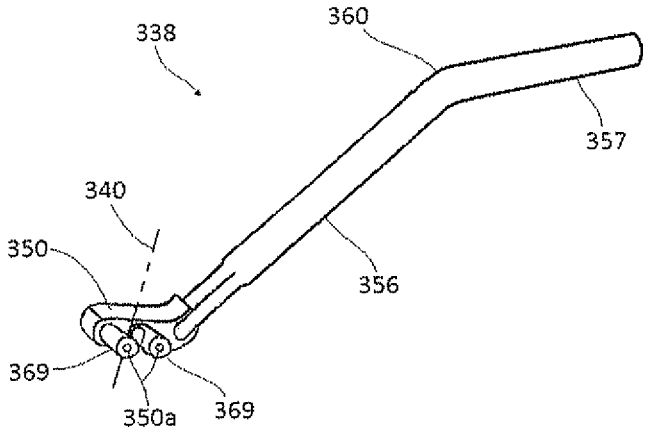
FIG. 15 is a front perspective view of an exemplary coupling according to one or more aspects of the present invention.

Referring to FIG. 15, in one or more aspects of the present invention, a coupling 338 includes elongated portions 356 and 357, and an elbow 360. An adjustable slotted head 350 is located at a first end of the coupling 338. Specifically, extensions 369 are secured to the coupling 338 with pins 350*a*, such that the extensions 369 are rotatable. Thus, the extensions 369 are configured to accommodate hosels of a variety of outer diameters with reduced marring. In this case, the slotted head 350 includes a head axis 340. However, the orientation of the head axis 340 varies depending on the orientation of the extensions 369.

Figure 16:
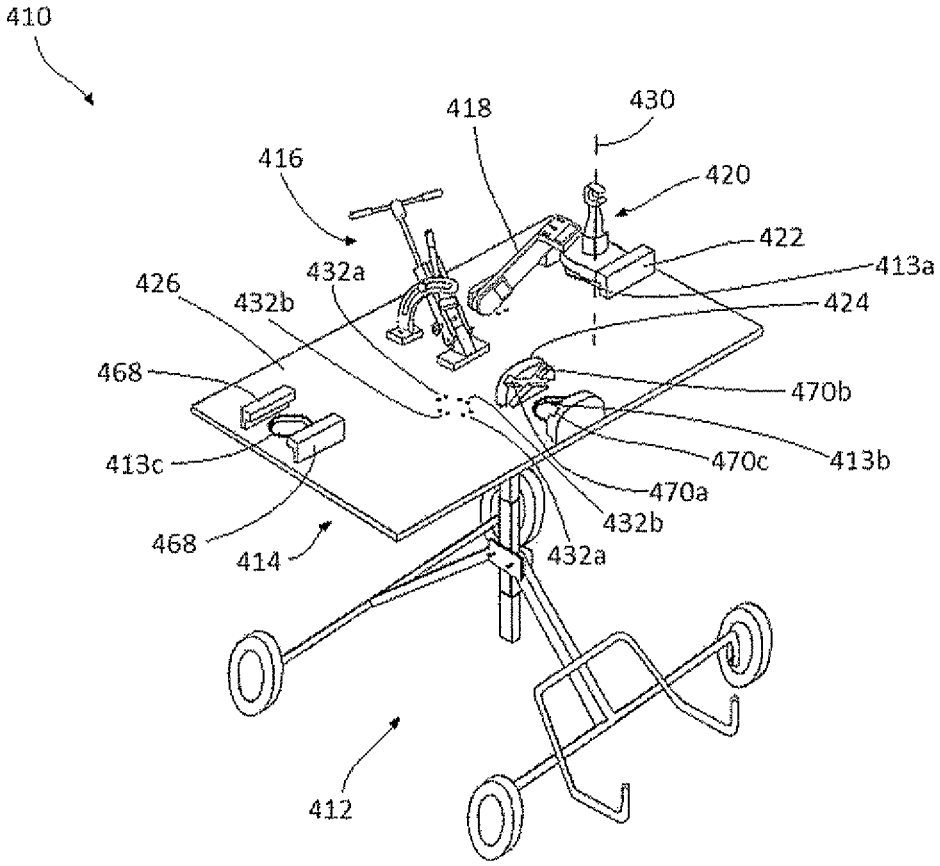
FIG. 16 is a front perspective view of an exemplary apparatus according to one or more aspects of the present invention.

Referring to FIG. 16, in one or more aspects of the present invention, an apparatus 410 is configured to adjust various characteristics, e.g. loft angle and lie angle, of right-handed and left-handed type golf clubs. Specifically, apparatus 410 includes a base 414 coupled to a movable cart 412. Secured to the base 414 are a clamp 416, an angular-displacement gauge 418, an actuator 420, and three discrete actuator mounts 422, 424, and 468.

As shown, actuator 420 is associated with the base 414 in a first operating position. Specifically, the actuator 420 is coupled to the actuator mount 422, which is coupled to the base 414. The actuator is reconfigurable to be coupled to the base 414 in a second operating position, by association with the actuator mount 424, or in a third operating position, by association with the actuator mount 468.

In the first operating position, as shown in FIG. 16, the actuator 420 is secured to the actuator mount 422. The angular-displacement gauge 418 is secured to the base 414 at a first mounting point. In this position, the angular-displacement gauge 418 is configured to fleshly engage with the shaft of a golf club, secured to the base 414, and to detect and display the lie angle of the club head, in a manner similar to that discussed with regard to the exemplary apparatus of the present invention shown in FIG. 1(B). Also, the apparatus 410 may be considered to be configured to adjust a lie angle of a right-handed type golf club.

The actuator mount 424 includes a first pair of parallel slots 470*a* and 470*c* and a second pair of parallel slots 470*b* and 470*d* (not shown) that extend obliquely relative to the base plane 426. Specifically, each of the slots of the first pair of slots 470*a* and 470*c* and the second pair of parallel slots 470*b* and 470*d* preferably forms an angle with the base plane 426, between about 15 and 45 degrees, more preferably between about 25 and 35 degrees, and most preferable equal to about 28 degrees. In a second operating position, the actuator 420 is secured to the actuator mount 424 by association with the slots 470*a* and 470*c*. The angular-displacement gauge 418 is secured to the base 414 at a second mounting point similarly to the aspect of the present invention shown in FIG. 1(D). In this position, the apparatus 410 may be considered to be configured to measure and adjust the loft angle of a right-handed type golf club. Alternatively, in a third operating position, the actuator 420 may be coupled to the base 414 by association with the slots 470*b* and 470*d* (not shown). Also, the angular-displacement gauge 418 is coupled to the base 414 by association with the mounting points 432*a*. In this position, when the angular-displacement gauge is flushly associated with a shaft of a golf club, secured to the base 414, the apparatus 410 may be considered to be configured to measure and adjust the loft angle of a left-handed type golf club.

In a fourth operating position, the actuator 420 is coupled to the base by association with actuator mount 468. Also, the angular-displacement gauge 418 is coupled to the base 414 by association with mounting points 432*b*. In this position, when the angular-displacement gauge 418 is flushly associated with a shaft of a golf club, secured to the base 414, the apparatus 410 may be considered to be in a position to measure and adjust the lie angle of a left-handed type golf club.

The apparatus 410 further includes actuator recesses 413*a*, 413*b*, and 413*c* for accommodating a portion of the actuator 420 in each of the first, second, third, and fourth operating position, as discussed above. The recesses 413*a*, 413*b*, and 413*c* each correspond to actuator mounts 422, 424 and 468, respectively. Specifically, the recesses are disposed such that, if the actuator 420 is secured to any of the actuator mounts 422, 424, and 468, the recess is configured to permit a portion of the actuator 420 to pass through the base plane 426. Preferably, one, some, or all of the recesses 413*a*, 413*b*, and 413*c* extend entirely through the base 414. However, in alternative aspects of the present invention, the recesses may extend only partially through the base 414.

Figure 17:
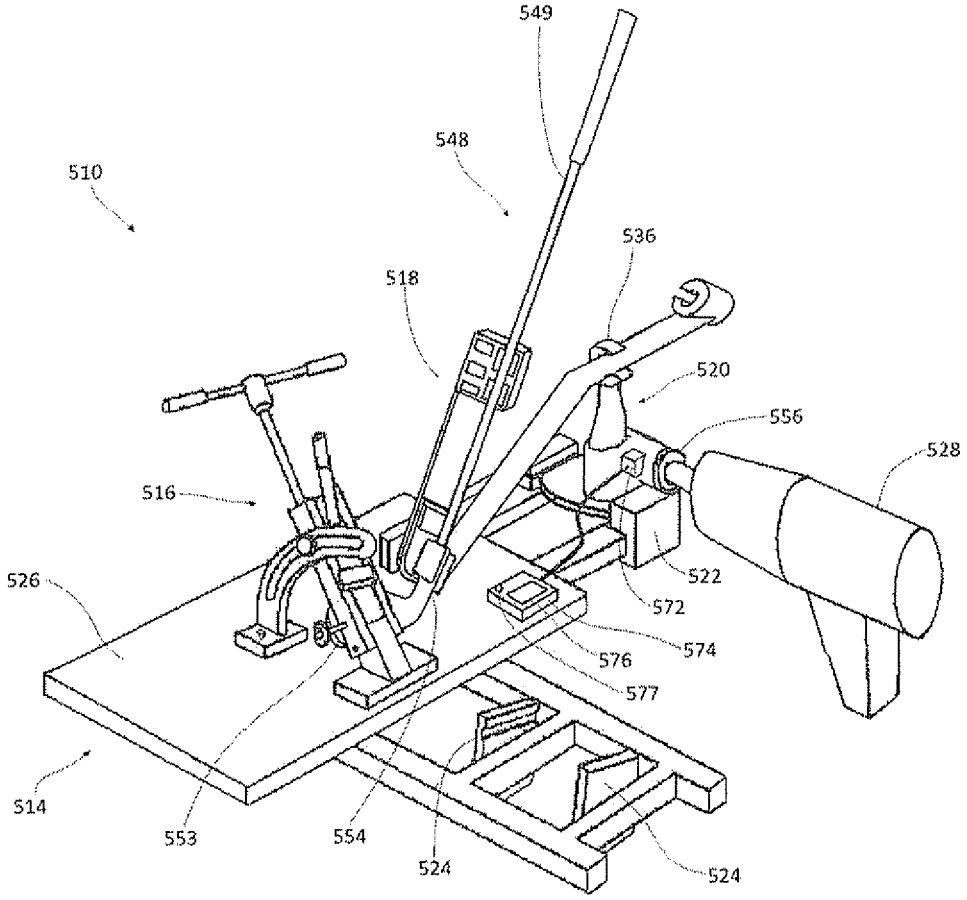
FIG. 17 is a front perspective view of an exemplary apparatus according to one or more aspects of the present invention.

Referring to FIG. 17, in one or more aspects of the present invention, an apparatus 510 includes a clamp 516, actuator mounts 522 and 524, an angular-displacement gauge 518 and an actuator 520. The actuator 520 may be removably secured to the actuator mount 522 for adjusting a characteristic of a golf club 548, for example a lie angle, in a first operating position. The actuator 520 may also be removably secured to the actuator mount 524 for adjusting a different characteristic of the golf club 548, for example a loft angle, in a second operating position. A driver 528 may be coupled to the input engagement portion 556 of the actuator 520 for providing a force to generate linear motion of the output engagement portion 536 of the actuator 520. As shown, the actuator 520 is a screw jack type actuator. However, other types of actuators may be substituted. For example, the actuator 520 may be a hydraulic type, pneumatic type, or a piezo-electric type.

A sensor 572 is associated with a moving portion of the actuator 520. Preferably, the sensor 572 attaches to a moving portion of the actuator 520 whose motion corresponds to the motion of the output engagement portion 536. In one or more aspects of the present invention, the sensor 572 is associated with the input engagement portion 556 of the actuator 520. The sensor 572 may include any other sensor, suitable for the purposes discussed herein, that is capable of detecting motion of an object relative to a reference location. Preferably, the sensor 572 includes a tachometer, particularly since the input engagement portion 556 of the actuator 520 involves rotational movement. More preferably, the sensor 572 includes a magneto-resistive tachometer. However, alternative types of tachometers, such as mechanical or photoelectric, may be substituted.

The sensor 572 is electronically connected to an output device 574. Preferably, output device 574 includes a display 576 and an alerting device 577. The display 576 is preferably a digital display. However, in alternative aspects of the present invention, the display 576 may be an analog type.

In some aspects of the present invention, the display 576 may display a displacement value detected by the sensor 572. In some aspects of the present invention, the display 576 may display values related to the detected displacement value. For example, display 576 may display a displacement value corresponding to the displacement of the output engagement portion 536 of actuator 520, based on a predetermined stored relationship between the detected displacement of a moving portion and an actuation portion. In some aspects, the display 576 may display values corresponding to a calculated amount of golf club head angular adjustment, based on a predetermined stored relationship between the detected displacement value of a moving portion of the actuator 520 and the corresponding amount of adjustment. For example, the predetermined relationship may relate the number of revolutions of the input engagement portion 556 to the number of degrees change in lie angle of the golf club. In some aspects of the present invention, the alerting device 577 may comprise a light and/or buzzer for alerting a user when a predetermined adjustment threshold is reached.

Figure 18:
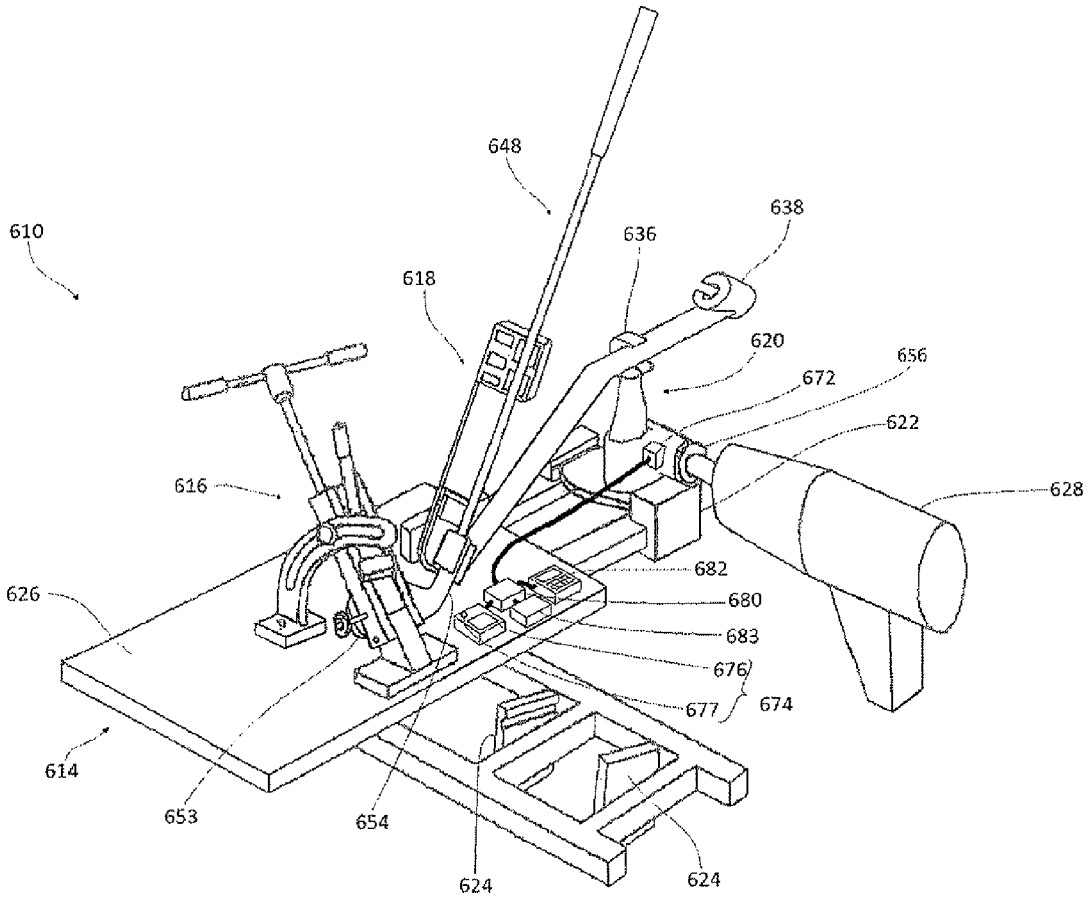
FIG. 18 is a front perspective view of an exemplary apparatus according to one or more aspects of the present invention.

Referring to FIG. 18, in one or more aspects of the present invention, an apparatus 610 includes a base 614, a clamp 616 for removably associating a golf club 648 with the base 614, an angular-displacement gauge 618, and actuator mounts 622 and 624. The apparatus 610 further includes an actuator 620 configured to removably associate with the base 614 in each of a first operating position, by association with the actuator mounts 622, and a second operating position, by association with the actuator mounts 624.

The actuator 620 includes an input engagement portion 656 for engaging with a driver 628, and an output engagement portion 636 for slidable association with a coupling 638. The driver 628 provides a force resulting in linear motion of the output engagement portion 636 of the actuator 620 along an actuation axis (not shown). As a result, the actuator 620 applies a bending force to coupling 638. The coupling 638 is coupled to a hosel 654 of the golf club 648. Thus, the bending force applied to the coupling 638 results in a bending force being applied to the hosel 654, which results in deformation, and adjustment, of the golf club 648.

The apparatus 610 further includes a sensor 672, an input device 682, and an output device 674. In one or more aspects of the present invention, the output device 674 includes a processor 680, a storage device 683, and a display 676. The sensor 672 is secured to a moving portion of actuator 620. The sensor 672 detects a displacement of a moving portion of the actuator 620 and sends a corresponding signal to the output device 674.

The input device 682 is electrically connected to the processor 680 of the output device 674. A user may interact with the input device 682 to send signals to the output device 674 corresponding to specific data of interest. For example, a user may interact with the input device 682 to input data related to a predetermined relationship between the measured displacement value of the sensor 672 and the amount of displacement of the output engagement portion 638, or the amount of desired adjustment of a portion of the golf club 648. In some aspects, the user may input data related to specific characteristics of golf clubs of interest.

Preferably, the input device 682 is configured to receive a user input of data related to material characteristics and/or structural characteristics of a specific golf club. For example, a user may input a value corresponding to spring-back or material properties that affect spring-back. As discussed above, spring-back corresponds to the ratio of an amount of displacement of a portion of a golf club under a specific stress to the permanent deformation determined to result from the stressing event. For example, a user may indicate that a golf club comprises a 17-4 stainless steel and/or includes a specific hosel bore thickness. As a result, the processor 680 may be configured to apply such characteristics in relating a detected displacement value with an actual adjustment value. One of ordinary skill in the art would appreciate that hosel bore geometry, material composition, heat treating processes, and coating processes may each affect an amount of adjustment of a golf club, or an amount of spring-back, which, in turn, affects the requisite amount of actuator motion per a specific desired post-adjustment value.

In one or more aspects of the present invention, the input device 682 is configured to receive data corresponding to a maximum displacement value corresponding to specific golf club materials and/or hosel geometries, above which damage to the golf club is likely to occur. Preferably, such data is stored in the storage device 683.

In one or more aspects of the present invention, the input device 682 is configured to receive data from a user corresponding to a desired amount of adjustment of a characteristic of the golf club. For example, the input device 682 may be configured to receive data indicating a desired lie adjustment of 1.5 degrees. Preferably, such data is stored in the storage device 683.

In one or more aspects of the present invention, the processor 680 is configured to generate an actual displacement value based on a predetermined stored relationship relating displacement value, detected by the sensor 672, to actual angular displacement of a portion of the golf club. In one or more aspects of the present invention, the processor 680 is configured to output the generated actual displacement value to the display 676. In some aspects of the present invention, the storage device 683 includes a volatile storage medium. Alternatively, or in addition, the storage device 683 includes a non-volatile storage medium. In some aspects of the present invention, the storage device 683 may also include a removable storage medium. Preferably, the processor 680 generates signals corresponding to adjustment values, and automatically sends such signals to the display 676 at periodic intervals. In some aspects of the present invention, the storage device 683 associated with the processor 680 is configured to store a plurality of settings and/or programs that each relate to different types or models of golf clubs, different materials, or different geometric properties.

Based on the output signal from the processor 680, the display 76 may display the amount of displacement of the moving portion (e.g. the number of revolutions of the input engagement portion 656) and/or the actual amount of adjustment. In some aspects of the present invention, the display 676 displays such information at periodic intervals. Alternatively, or in addition, the display 676 displays the output value when an amount of adjustment corresponds to an inputted desired amount of adjustment. Alternatively, or in addition, the display 676 displays the output value based on a user's inputted request to display such information.

In one or more aspects of the present invention, the display 676 generates an alert based on information received from the sensor 672 and information stored in the storage device 683. In some aspects of the present invention, the alert includes an activation of a light or a sound-emanating device. Alternatively, or in addition, the alert may include the display of a message, such as "Adjustment Completed," on an electronic display, such as an LCD screen or the like.

Figure 19:
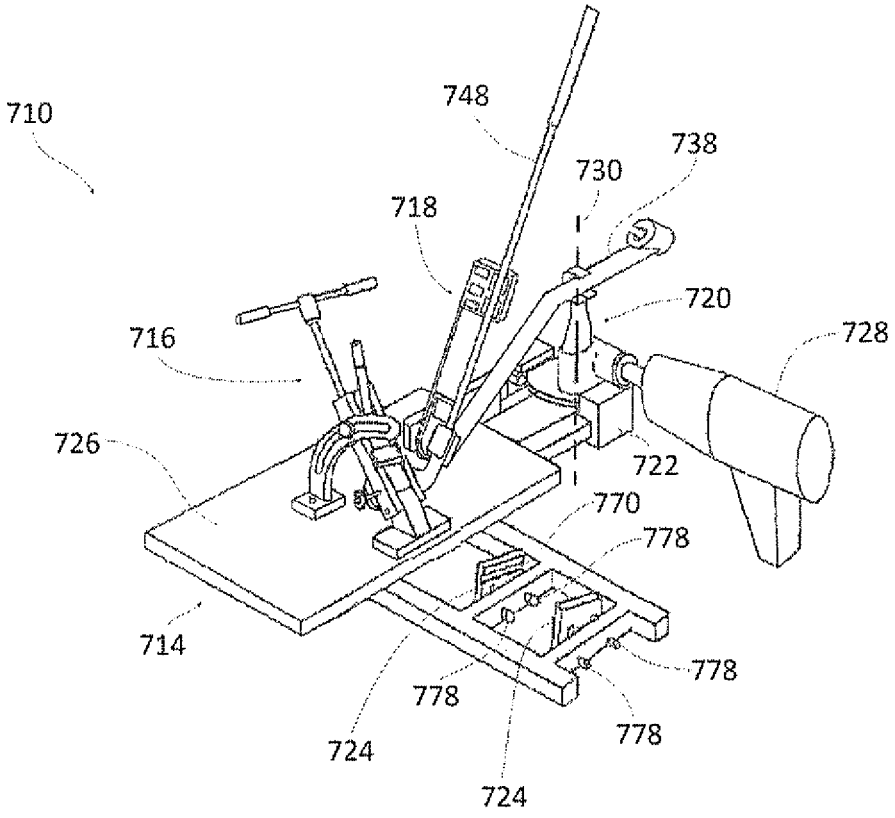
FIG. 19 is a front perspective view of an exemplary apparatus according to one or more aspects of the present invention.

Referring to FIG. 19, in one or more aspects of the present invention, an apparatus 710 includes a base 714 having a base plane 726, a clamp 716, an angular-displacement gauge 718, an actuator 720, and actuator mounts 722 and 724. Actuator 720 includes an actuation axis 730. In a first operating state, the actuator 720 is associated with actuator mounts 722. In a second operating state, the actuator 720 is associated with actuator mounts 724. The actuator mount 724 includes slots 770 and an angle adjustment device 778 for adjustably securing the actuator mount 724 to the base 714. Specifically, the angle adjustment device 778 provides a means for attaching the actuator mount 724 to the base 714 in any of a variety of angular positions. Accordingly, the orientation of the actuation axis 730 of the coupling 738 may be optimized to the specific characteristics of the golf club 748. For example, angle adjustment device 778 may be used to adjust the angular orientation of actuator mount 724, and, thus, the actuation axis 730 when the actuator 720 is in the second operating position, to correspond to the lie angle of a specific golf club 748 to be adjusted.

Figure 20:
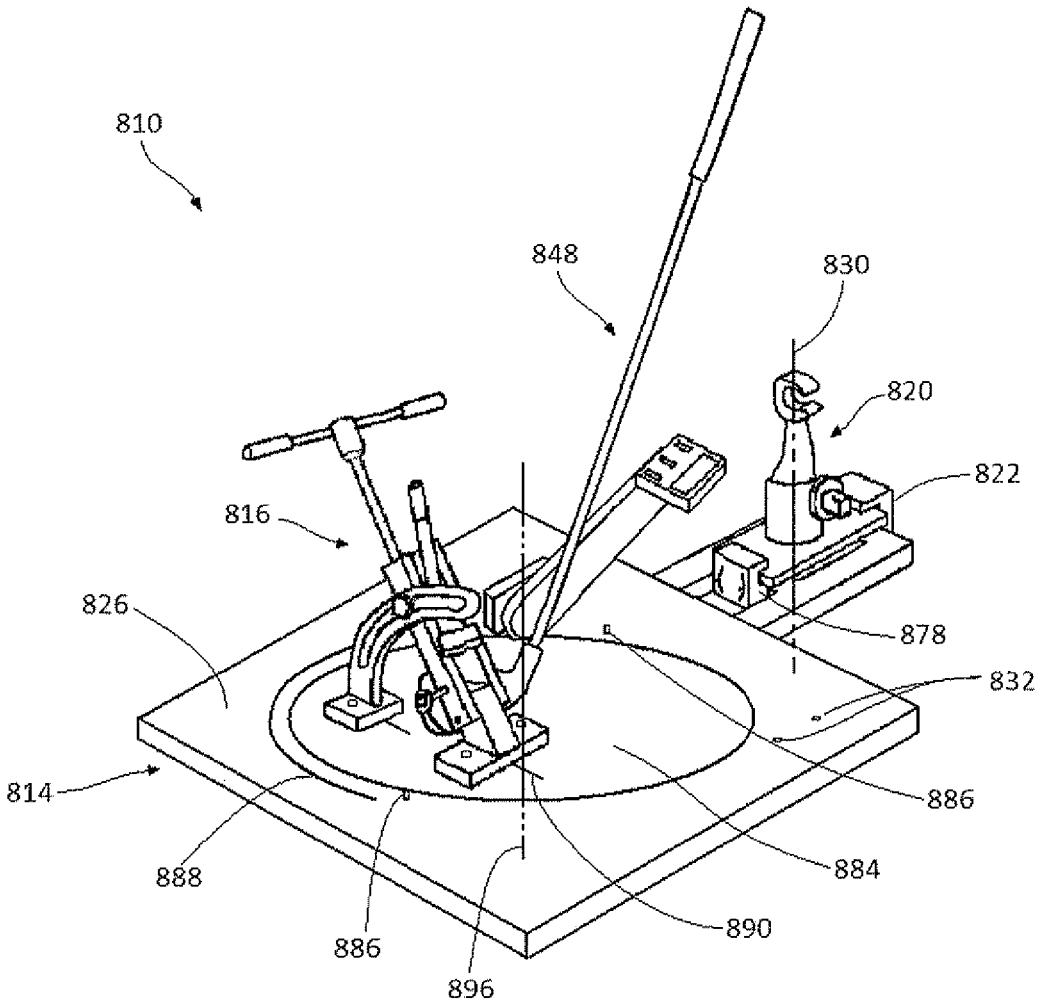
FIG. 20 is a front perspective view of an exemplary apparatus according to one or more aspects of the present invention.

Referring to FIG. 20, in one or more aspects of the present invention, an apparatus 810 includes a base 814 having a base plane 826, a clamp 816 for securing a golf club 848 to the base 814, an actuator 820, and an actuator mount 822 for securing the actuator 820 to the base 814. The actuator 820 includes an actuation axis 830.

The base 814 further includes a rotating portion 884 configured to rotate about an axis of rotation 896, and to be fixed in a selected position by fasteners 886. The clamp 816 is secured to the rotating portion 884. Thus, in an operating position, when a golf club 848 is secured to clamp 816, the golf club 848 is also rotatable with respect the actuator 820. The rotating portion 884 permits a user to perform multiple golf club adjustments, e.g., a loft angle and a lie angle, without relocating the actuator 820. Accordingly, bulkiness may be further reduced.

In one or more aspects of the present invention, referring again to FIG. 20, the base 814 further includes an alignment guide 888 for providing a visual indication of the rotational position of rotating portion 884 relative to a fixed portion of the base 814. The alignment guide 888 may include markers or ticks representing degrees of rotation relative to a reference point. The apparatus 810 is shown in a first operating position suitable for adjusting the lie angle of the golf club 848. The apparatus 810 may be reconfigured to be in a second operating position suitable for measuring the loft angle of a golf club. Specifically, in reconfiguring the apparatus 810 to be in the second operating position, the user need only loosen the fasteners 886 and rotate the rotating portion 884 until the alignment guide 888 indicates a change in rotational position of 90 degrees clockwise. Then, the user may secure the apparatus 810 in the second operating position by tightening the fasteners 886. Also, in the second operating position, the angular-displacement gauge is relocated and secured in the angular-displacement gauge mount 832.

Preferably, the clamp 816 is secured to the rotating portion 884 such that the axis of rotation 896 is generally coincident with the center point of the hosel 854. Thus, a coupling (not shown) applied to the apparatus 810 would associate with the golf club in approximately the same location regardless of whether the apparatus 810 is in the first operating position or in the second operating position. Thus, the configurations of the coupling and the actuator mount 822 may be further simplified. In alternative aspects of the present invention, the rotating portion 884 and the clamp 816 may be configured such that the associated axis of rotation 896 may be positioned elsewhere relative to the clamp 816. For example, the clamp 816 may be secured to the rotating portion 884 such that the axis of rotation 896 runs through the center of the clamp 816. In this manner, the bulkiness of the base 814 may be reduced.

In some aspects of the present invention, the rotating portion 884 may further include a positional alignment device 890. The positional alignment device 890 provides a means for translational adjustment of the clamp 816. Adjusting the position of the clamp 816 in this manner is advantageous in correcting any misalignment between the location of the hosel 854 of the golf club 848 and the desired position the coupling, particularly if the secured golf club includes an offset hosel. One of ordinary skill in the art would appreciate the applicability of these features to other aspects of the present invention discussed herein, as well as aspects of the present invention not discussed herein.

An angle adjustment device 878 is provided to adjust the angular position of the actuator 820. Permitting the actuator 820 to change angular positions is particularly if the apparatus 810 includes only one actuator mount 822, as shown, for carrying out multiple adjustment operations. For adjusting the lie angle of the golf club 848, a user may secure the actuator 820 in a first operating position such that an actuation axis 830 of the actuator 820 is substantially perpendicular relative to the base plane 826. For adjusting the loft angle of the golf club 848, in addition to adjusting the position of the rotating portion 884, the user may secure the actuator 820 in a position such that the actuation axis 830 forms an angle with the base plane 826, measured in an imaginary plane perpendicular to the base plane 826, corresponding to the lie angle of the golf club 848. One of ordinary skill in the art would appreciate the applicability of these features to other aspects of the present invention discussed herein, as well as aspects of the present invention not discussed herein.

Figure 21A:
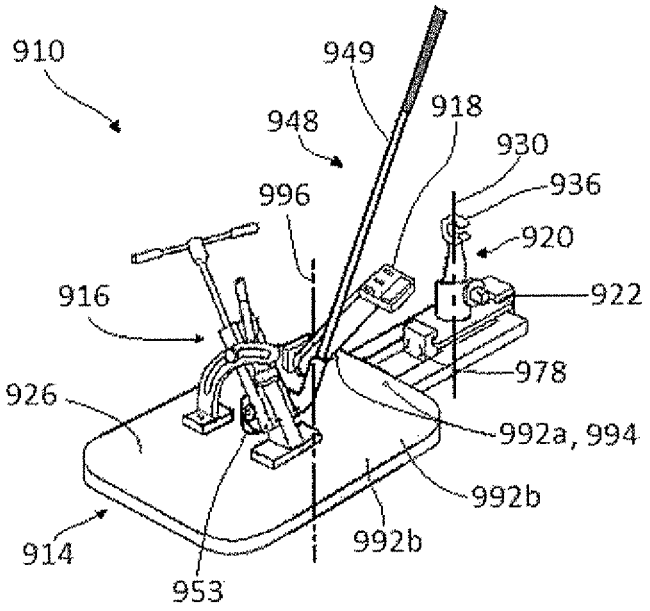
FIG. 21(A) is a front perspective view of an exemplary apparatus according to one or more aspects of the present invention.
Figure 21B:
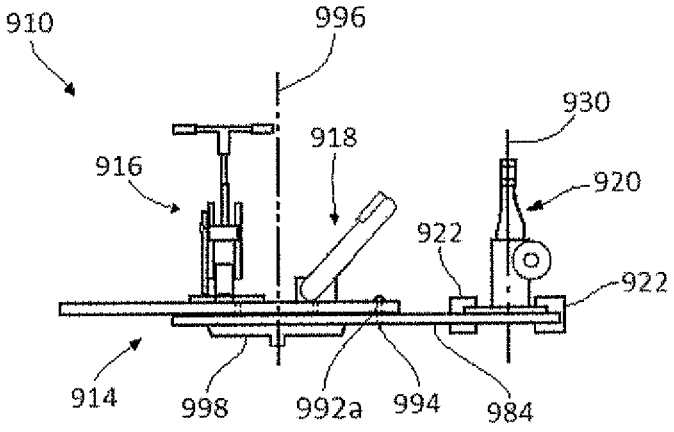
FIG. 21(B) is a front elevation view of the exemplary apparatus of FIG. 21(A), according to one or more aspects of the present invention.

Referring to FIGS. 21(A) and 21(B), in one or more aspects of the present invention, an apparatus 910 includes a base 914 including a base plane 926, a clamp 916 for securing a golf club 948 to the base 914, an angular-displacement gauge 918, an actuator 920 having an actuation axis 930, and an actuator mount 922 for securing the actuator 920 to the base 914. The apparatus 910 is reconfigurable from a first operating position, suitable for measuring and adjusting the lie angle of a secured golf club, such as a golf club 948, to a second operating position, suitable for measuring and adjusting the loft angle of a secured golf club, such as the golf club 948. Specifically, the base 914 includes a rotating portion 984, on which the actuator mount 922 is secured, and a supporting plate 998. The actuator 920 is rotatable with respect to the clamp 916. The rotating portion 984, to which the actuator 920 is secured, pivots about an axis of rotation 996. Preferably, the axis of rotation 996 is generally coincident with a location that corresponds to the intended location of the center of the hosel 954 of the secured golf club 948. Thus, a coupling (not shown) applied to the apparatus 910 would associate with the golf club 948 in the same location regardless of whether the apparatus 910 is in the first operating position or in the second operating position. However, in alternative aspects of the present invention, the rotating portion 984 is configured such that the axis of rotation 996 is coincident with the center of the clamp 916, in consideration other structural factors, such as the overall weight balance of the apparatus 910.

Pins 994 are removably inserted into pin holes 992*a* to fix the location of rotatable portion 984 in the first operating position. By removing the pins 994 from the pin holes 992*a*, rotatable portion 984 may freely rotate to be in another position. Pins 994 are removably insertable into pin holes 992*b* to fix the location of rotatable portion 984 in the second operating position. In alternative aspects of the present invention, set screws, clamps, curved slots, or the like, or any combination thereof, are used to secure the position of the rotating member 984 in various orientations.

Actuator mount 922 may include an angle adjustment device 978 for adjusting the angular orientation of the actuator 920 relative to the base plane 926. The actuator 920, the actuator mount 922, and the angle adjustment device 978 are configurable such that, in the first operating position, an angle formed between the actuation axis 930 and the base plane 926, measured in an imaginary plane perpendicular to the base plane 926, is between 70 and 120 degrees, more preferably between 80 and 110 degrees, and most preferably equal to about 90 degrees. Also, the actuator 920, the actuator mount 922, and the angle adjustment device 978 are preferably configurable such that, in the second operating position, an angle formed between the actuation axis 930 and the base plane 926, measured in an imaginary plane perpendicular to the base plane, is oblique, more preferably between about 52 and 72 degrees, and most preferably equal to about 62 degrees.

Figure 22:
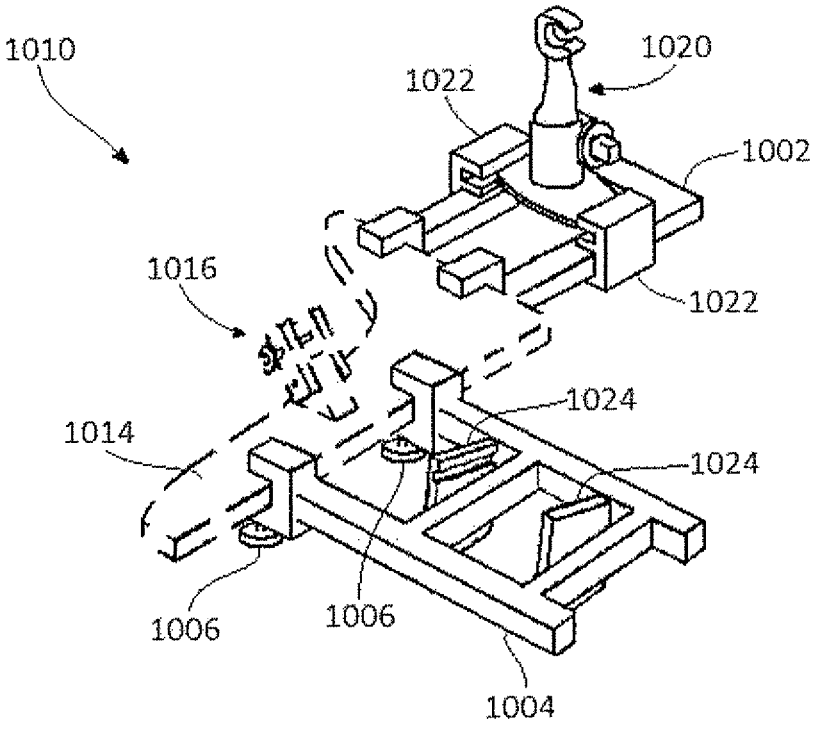
FIG. 22 is a front perspective view of an exemplary apparatus according to one or more aspects of the present invention.

Referring to FIG. 22, in one or more aspects of the present invention, a kit 1010 includes an actuator 1020 for association with a coupling (not shown), actuator mounts 1022 and 1024, and attachment members 1002 and 1004 for securing actuator mounts 1022 and 1024 to a preexisting base 1014. Each of attachment portions 1002 and 1004 include fasteners 1006 for removably attaching each of the attachment portions 1002 and 1004 to the base 1014. In one or more aspects of the present invention, fasteners 1006 are configured to secure each of the attachment portions 1002 and 1004 to bases of different thicknesses and/or other properties. Alternatively, or in addition, fasteners 1006 may be configured to secure each of the attachment portions 1002 and 1004 to a base of a predetermined thickness. In a first operating position suited for adjusting the lie angle of a golf club (not shown) secured to the base 1014, the actuator 1020 is secured to the actuator mount 1022. In a second operating position suited for adjusting the loft angle of the secured golf club, the actuator 1020 is secured to the actuator mount 1024. By providing a kit 1010 including attachment members 1002 and 1004 with fasteners 1006, users may enhance the functionality of their pre-existing equipment.

Figure 23:
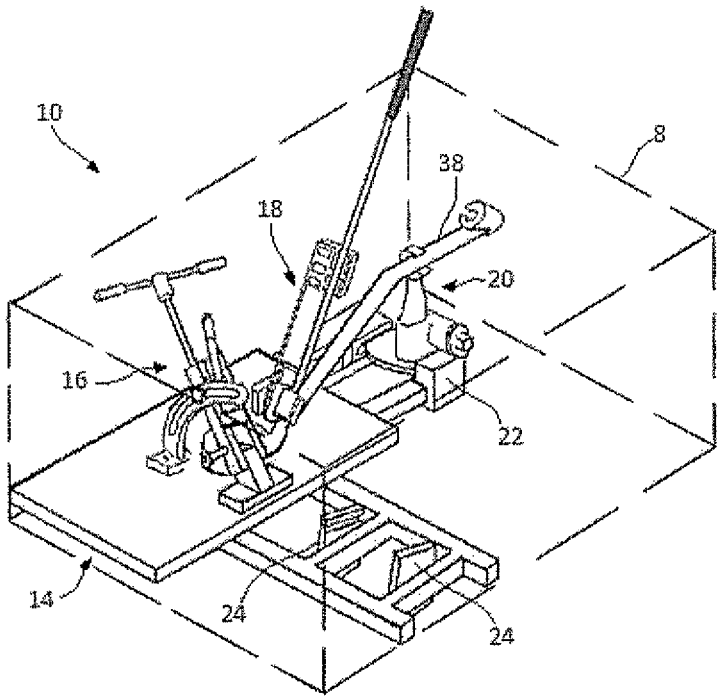
FIG. 23 is a front perspective view of a portion of the exemplary apparatus of FIG. 1(A), in the first operating position, superimposed with an imaginary effective operating volume.

Referring to FIG. 23, in one or more aspects of the present invention, an apparatus 10 includes a base 14, a clamp 16, an angular-displacement gauge 18, an actuator 20, and actuator mounts 22 and 24. In at least one operating position, as shown, the base 14, the clamp 16, the angular-displacement gauge 18, the actuator 20, and the actuator mounts 22 and 24 occupy an effective operating volume 8. "Effective operating volume" is defined herein as the volume of the smallest rectangular prism bounding the outermost extents of the apparatus 10 in at least one operating position, the apparatus including the base 14, the actuator 20, the actuator mounts 22 and 24, the coupling 38, the clamp 16, and the angular-displacement gauge 18. Preferably, the effective operating volume 8 is less than or equal to about 0.25 $m^2$. More preferably, the effective operating volume 8 is less than or equal to about 0.15 $m^2$. Most preferably, the effective operating volume 8 is less than or equal to about 0.12 $m^2$.

Figure 24:
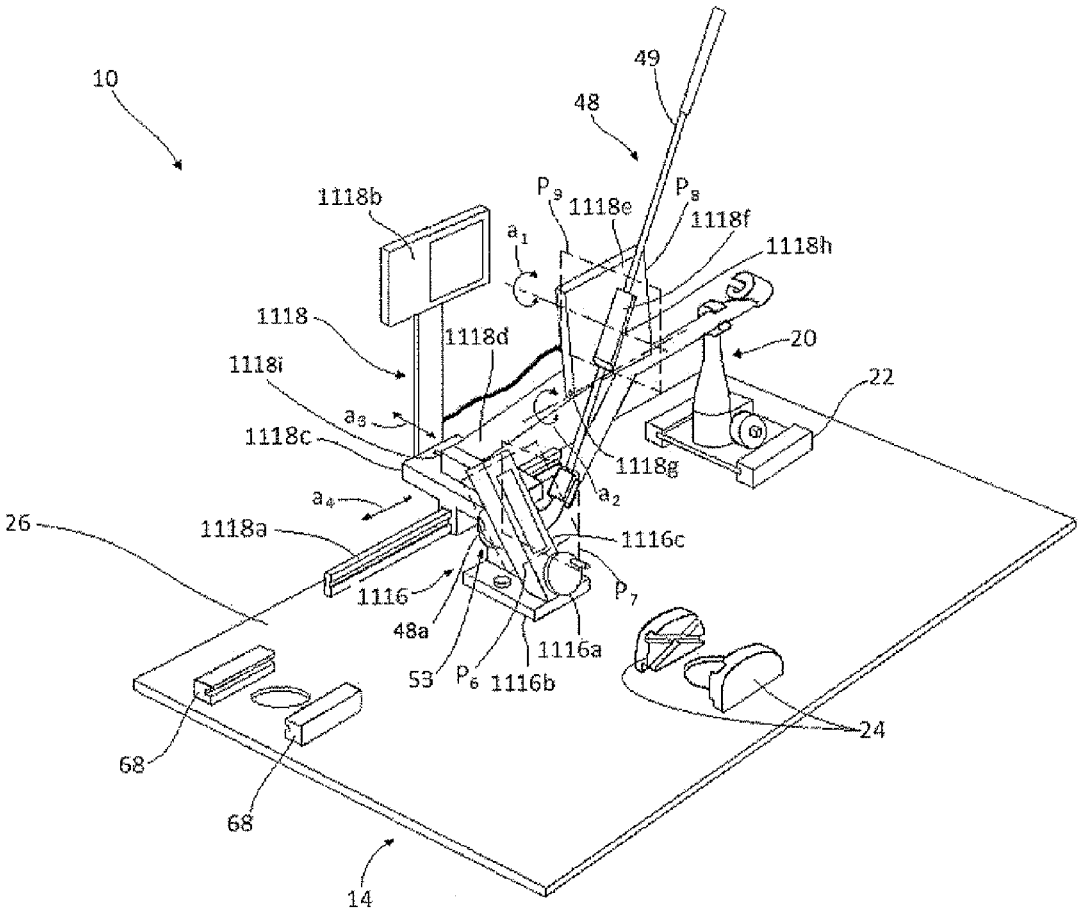
FIG. 24 is a front perspective view of an exemplary apparatus according to one or more aspects of the present invention.

In one or more aspects of the present invention, referring to FIG. 24, an apparatus 10 includes a base 14 having a base plane 26, a clamp 1116 for securing a golf club 48 to the base 14, actuator mounts 22, 24, and 68, an actuator 20, and an angular-displacement gauge 1118. The golf club 48 includes a shaft 49, a striking face 48*a*, and a hosel 54. The clamp 1116 is configured to secure the golf club 48 to the base 14. The clamp 1116 includes a tightener 1116*a* for securing the golf club thereto, a base plate 1116*b* for securing the clamp 1116 to the base 14, and an abutment plate 1116*c* for abutting the striking face 48*a* of the golf club 48 such that the plane $P_6$ of the striking face 48*a* is located in a known fixed position, when the golf club 48 is secured to the clamp 1116.

Preferably, the apparatus 10 is configured such that, when the golf club head 48 is secured to the apparatus 10, in an imaginary plane $P_7$ perpendicular to the striking face plane $P_6$ and perpendicular to the base plane 26, the striking face plane $P_6$ forms an angle with the base plane 26 between about 30 and about 70 degrees, more preferably between about 40 and about 60 degrees, even more preferably between about 45 and about 55 degrees, and most preferably equal to about 50 degrees.

The angular-displacement gauge 1118 includes a display 1118*b*, a first slider 1118*a*, a first translating member 1118*c* slidably coupled to the first slider 1118*a*, and a second translating member 1118*d*. The first translating member 1118*c* is configured to slide along a directional axis $a_4$. The first translating member 1118*c* includes a second slider 1118*i*. The second translating member 1118*d* is slidably coupled to the first translating member 1118*c* by association with the slider 1118*i*. The second translating member 1118*d* is configured to slide along a directional axis $a_3$. The directional axis $a_3$ is generally perpendicular to the directional axis $a_4$. Further, both of the directional axes $a_3$ and $a_4$ are generally parallel to the base plane 26.

A first pivoting member 1118*e* is rotatably coupled to the second translating member 1118*d*. The rotation of the pivoting member 1118*e* is enabled by pins 1118*g*, and the first pivoting member 1118*e* rotates about axis $a_2$. A second pivoting member 1118*f* is rotatably coupled to the first pivoting member 1118*e* by a pin 1118*h*. The second pivoting member 1118*h* pivots about an axis $a_1$. Provided with such translational and rotational movement, the angular-displacement gauge 1118 enables dynamic measurement of the loft angle and/or the lie angle of either a right-handed type or a left-handed type golf club. Specifically, to move from a position configured to measure the loft angle and/or lie angle of a right-handed golf club to a position configured to measure the loft angle and/or lie angle of a left-handed type golf club, the first translating member 1118*e* is moved from a position toward the actuator mount 22 to the a position toward the actuator mount 68.

To measure the loft angle of, e.g., a right-handed type golf club, the golf club head 53 is secured to the clamp 1116 such that the scorelines on the striking face of the golf club head 53 are parallel to the base plane 26 and the striking face is flush against the club head attachment portion of the clamp 16. The first pivoting member 1118*e* is moved into flush engagement with the shaft 49 of the golf club 48. The loft angle of the golf club 48 is related to the angle formed between a general plane $P_8$ of the first pivoting member 1118*e* and the base plane 26, measured in an imaginary plane $P_9$ perpendicular to the plane $P_8$ and perpendicular to the base plane 26. Preferably, the display 1118*b* is configured to display a loft value based on the angle formed between the plane $P_8$ and the base plane 26, in the imaginary plane $P_9$, and based on the predetermined fixed angle of the clamp 1116 that is formed between the plane $P_6$ of the striking face 48*a* when the golf club 48 is secured to the clamp 16, as discussed above, and the base plane 26, in the imaginary plane $P_7$. Specifically, the display 1118*b* includes a processor (not shown) and is electronically connected to a first angular-displacement sensor (not shown) in communication with the first pivoting member 1118*e*. The processor calculates the loft angle of the golf club by receiving a value corresponding to the angular displacement of the plane $P_8$ relative to the base plane 26, measured in the plane $P_9$, and subtracting therefrom a value corresponding to the predetermined fixed angle of the clamp 1116 formed between the plane $P_6$ and the base plane 26, measured in the plane $P_7$.

In one or more aspects of the present invention, the first pivoting portion 1118*e* includes magnetic portions (not shown) to ensure that the first pivoting portion remains flushly engaged with the shaft 49, even as the position of the shaft is being adjusted. This enables the display 1118*b* of the angular-displacement gauge 1118 to dynamically display a value for the loft angle of the golf club 48. Alternatively, or in addition, the first pivoting member 1118*e* is spring-biased to further enable flush, but slidable, engagement of the first pivoting member 1118*e* and the shaft 49 during an adjustment of the position of the shaft 49. Alternatively, or in addition, the first pivoting member 1118*e* includes a hook or clamp for slidably securing the shaft 49 to the first pivoting member 1118*e*. Such hook, or clamp, may be preferable, particularly if a shaft of a golf club to be secured to the apparatus 10 is substantially non-ferrous (e.g., a graphite shaft).

To measure the lie angle of the golf club 48, once the first pivoting member 1118*e* is flushly engaged with the shaft 49, and the scorelines of the striking face 48*a* of the golf club 48 are parallel to the base plane 26, the second pivoting member 1118*f* is pivoted about axis $a_1$ by a pin 1118*h*, until the second pivoting member 1118*f* is also flushly engaged with the shaft 49. The second pivoting member 1118*f* is associated with an angular displacement sensor (not shown) that transmits information to a data processor, which converts the information into an angle value corresponding to the angle between the shaft axis and the base plane 26. The angle is measured in an imaginary plane parallel to the plane $P_8$ and containing the shaft axis. In one or more aspects of the present invention, the display 1118*b* of the angular-displacement gauge 1118 displays the lie angle value. Optionally, the angular-displacement gauge 1118 is configured to display a lie angle value dynamically, for example at periodic intervals as a lie angle adjustment is being conducted.

Figure 25:
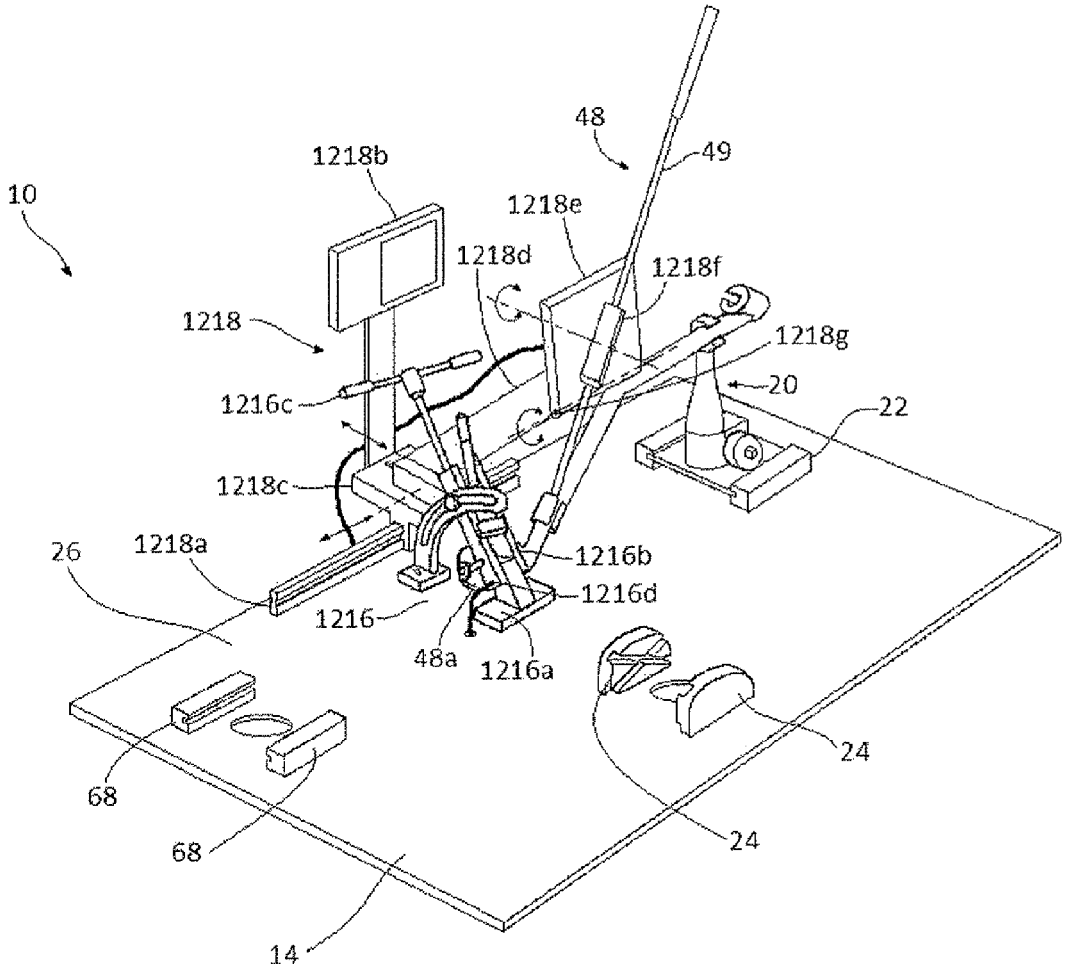
FIG. 25 is a front perspective view of an exemplary apparatus according to one or more aspects of the present invention.

Referring to FIG. 25, in one or more aspects of the present invention, an apparatus 10 includes a base 14 having a base plane 26, actuator mounts 22, 24, and 68 secured thereto, an adjustable clamp 1216 coupled to the base 14, an actuator 20 coupled to the actuator mount 22, and an angular-displacement gauge 1218 slidably coupled to the base 14. The actuator mounts 22, 24, and 68, the actuator 20, and the angular-displacement gauge 1218 are similar to the corresponding features of the aspect of the present invention shown in FIG. 24. Particularly, angular-displacement gauge 1218 includes a first translating member 1218*c*, a second translating member 1218*d*, a first pivoting member 1218*e*, which pivots about pin 1218*g*, a second pivoting member 1218*f*, which pivots about pin 1218*h*, and a display 1218*b*, including a processor (not shown) for calculating and displaying values that correspond to properties of the golf club 48.

The clamp 1216 includes a pivoting portion 1216*b* rotatably coupled to a base plate 1216*ba*. The clamp 1216 further includes an angular-displacement sensor (not shown) coupled to a pin 1216*d*, about which the pivoting portion 1216*b* rotates. Angular-displacement sensors are also associated with each of the first pivoting portion 1218*e* and the second pivoting portion 1218*f*. Preferably, the angular-displacement gauge 1218 includes a processor configured to calculate a loft angle of the golf club 48 based on electronically input data from each of the angular-displacement sensors associated with the pivoting portion 1216*b* and associated with the first pivoting portion 1218*e*. Specifically, the processor determines the loft angle of the club head by calculating the difference between: (a) the measured angle formed between a plane of the first pivoting member 1218*e* and the base plane 26, when the shaft 49 is flushly associated with the first pivoting member 1218*e*, measured in an imaginary plane perpendicular to the plane of the first pivoting member 1218*e* and perpendicular to the base plane 26; and (b) the angle formed between a plane of a striking face 48*a* of the golf club 48, when the golf club 48 is flushly secured to the pivoting portion 1216*b* of the clamp 1216, measured in an imaginary plane perpendicular to the plane of the striking face 48*a* and perpendicular to the base plane 26. Enabling the clamp 1216 to be rotatable, the golf club 48 may be set in a position for improved adjustment of its loft angle and/or lie angle. The lie angle of the golf club 48 may be determined in the manner set forth above with regard to the aspect of the present invention shown in FIG. 24.

Figure 26:
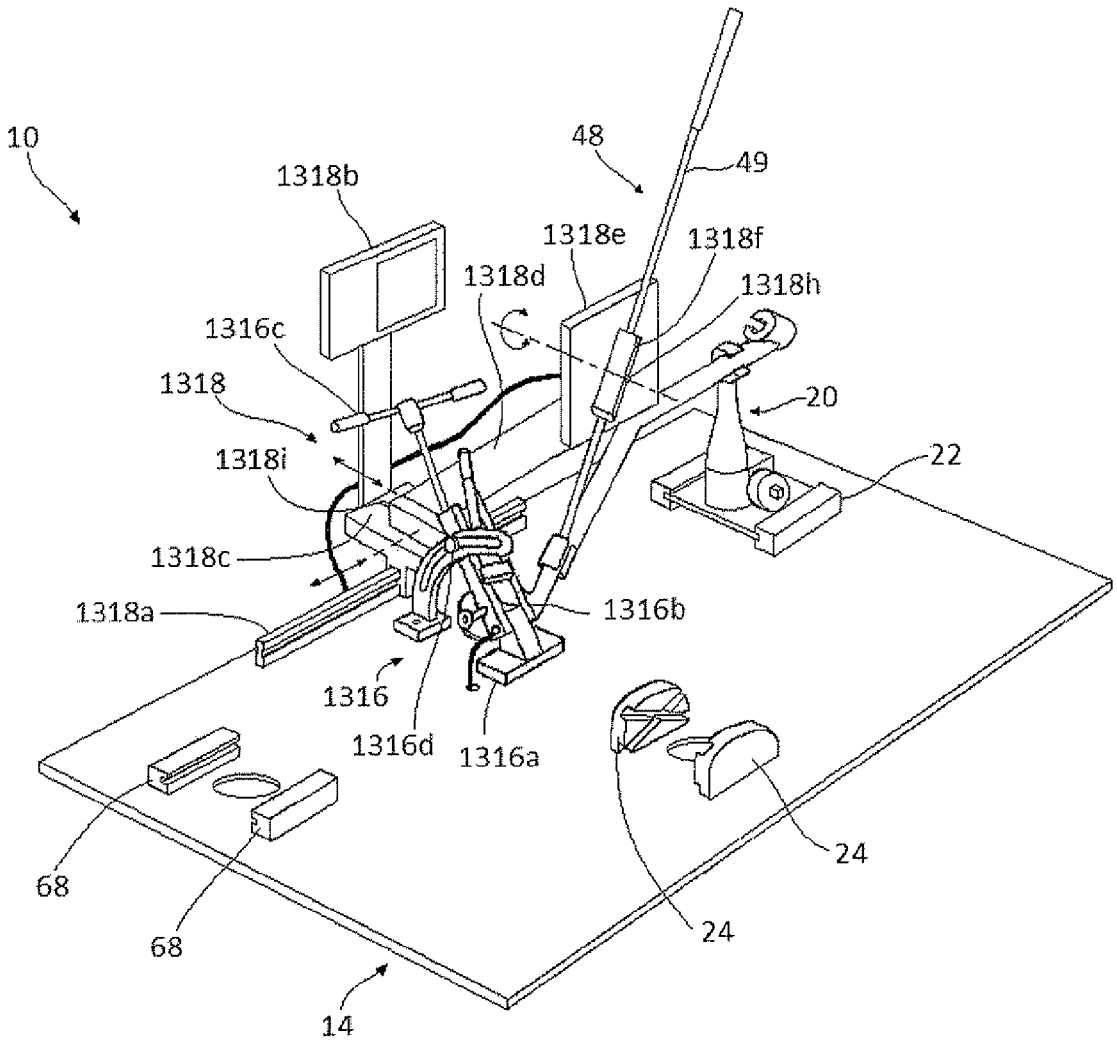
FIG. 26 is a front perspective view of an exemplary apparatus according to one or more aspects of the present invention.

Referring to FIG. 26, in one or more aspects of the present invention, an apparatus 10 includes a base 14 having a base plane 26. Secured to the base 14 are actuator mounts 22, 24 and 68, a clamp 1316, and angular-displacement gauge 1318. An actuator 20 is removably secured to the actuator mount 22. The clamp 1316 includes a base plate 1316*a*, a pivoting portion 1316*b* rotatably secured to the base plate 1316*a*, a golf club securing means 1316*c*, and a loft angle indicator 1316*d*. When a golf club 48 is secured to the clamp 1316 such that the striking face 48*a* flushly engages with the pivoting portion 1316*b*, the scorelines of the striking face 48*a* are generally parallel to the base plane 26, and the shaft 49 lies in a shaft plane perpendicular to the base plane 26, then the loft angle indicator 1316*d* indicates the actual loft angle of the golf club 48.

The angular-displacement gauge 1318 includes a slider 1318*a*, a display 1318*b*, a processor (not shown), a first translating member 1318*c*, a second translating member 1318*d* having a shaft abutment plate 1318*e*, and a pivoting member 1318*f* that pivots about pin 1318*h*. The second translating member 1318*d* translates about a second slider 1318*i*. The shaft abutment plate 1318*e* forms a plane generally perpendicular to the base plane 26 and the shaft abutment plate 1318*e* is configured such that an imaginary plane perpendicular to the general plane of the shaft abutment plate and perpendicular to the base plane 26 is parallel to an imaginary plane that is perpendicular to the striking face 48*a* of the golf club 48 and perpendicular to the base plane 26. Accordingly, the angular position of the shaft abutment plate 1318*e* remains constant.

When the shaft 49 is flushly engaged with the shaft abutment plate 1318*e*, then the loft angle indicator 1316*d* corresponds to the actual loft of the golf club 48. Also, when the shaft abutment plate 1318*e* is flushly engaged with the shaft 49, and the pivoting member 1318*f* is flushly engaged with the shaft 49, then the angular position of the pivoting member 1318*f* corresponds to the lie angle formed between the shaft axis and the base plane. The lie angle is measured in an imaginary plane perpendicular to the base plane and containing the shaft axis. The display 1318*b* preferably displays at least the lie angle of the golf club 48. In some aspects of the present invention, the display 1318*b* displays the lie angle of the golf club 48, and displays the loft angle associated with the golf club 48.

Figure 27A:
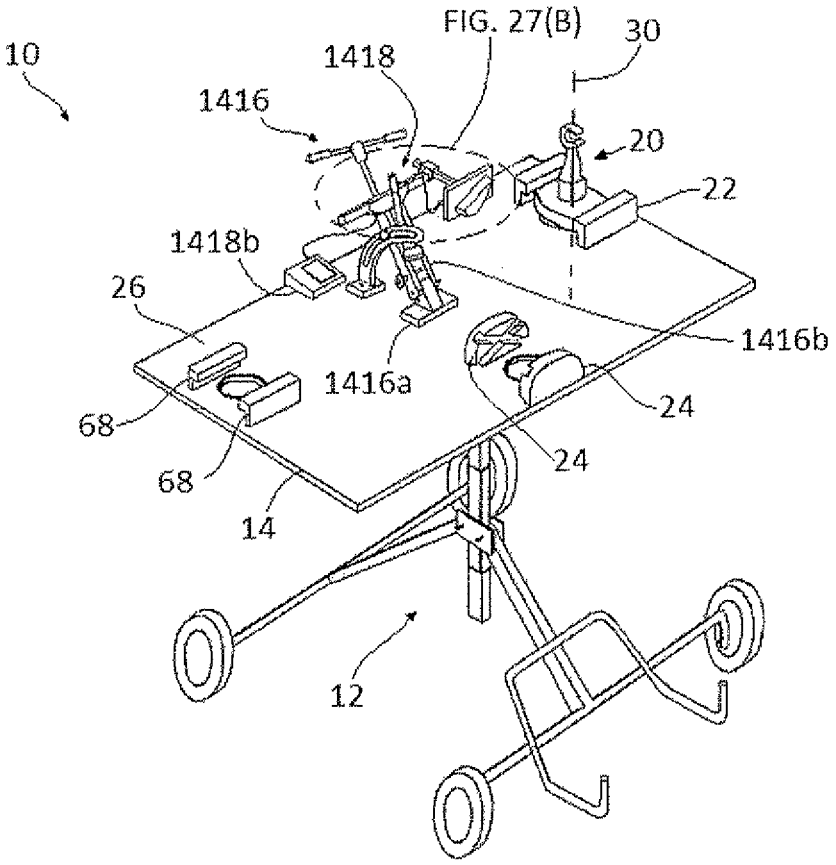
FIG. 27(A) is a front perspective view of an exemplary apparatus according to one or more aspects of the present invention.
Figure 27B:
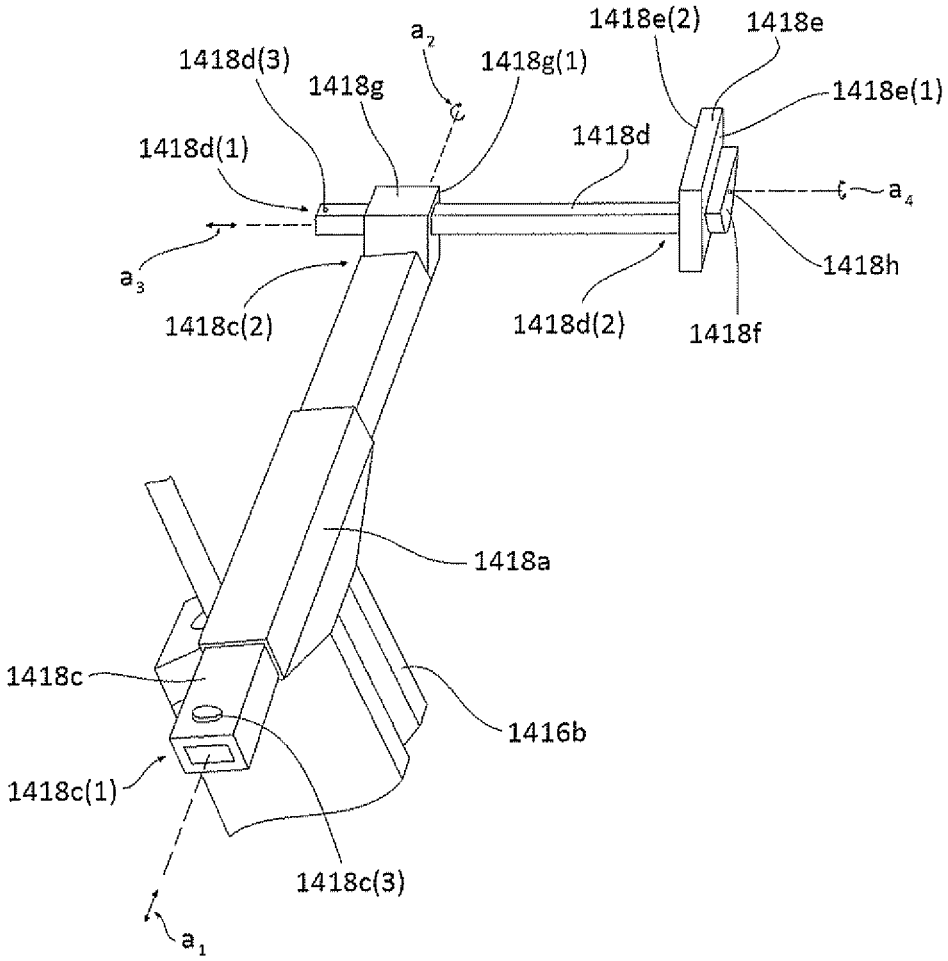
FIG. 27(B) is a left-side perspective view of a detail of the exemplary apparatus of FIG. 27(A).

Referring to FIG. 27(A) and FIG. 27(B), in one or more aspects of the present invention, an apparatus 10 includes a base 14 having a base plane 26. A movable cart 12 is coupled to the base 14. Also secured to the base 14 are actuator mounts 22, 24, and 68, a clamp 1416, and an angular-adjustment gauge 1418 having a display 1418*b*. The angular-displacement gauge 1418 is secured to the clamp 1416. The clamp 1416 is angularly-adjustable in the manner discussed above with regard to the aspect of the present invention shown in FIG. 26.

As particularly shown in FIG. 27(B), the angular-displacement gauge 1418 includes a collar member 1418*a* and a first sliding member 1418*c* slidably engaged with the collar member 1418*a*. The first sliding member 1418*c* includes a first end 1418*c*(1) and an opposing second end 1418*c*(2). A stop 1418*c*(3) is removably insertable into the first sliding member 1418*c* proximate the first end 1418*c*(1). The first sliding member 1418*c* slides about a directional axis $a_1$, guided by the collar member 1418*a*. The directional axis $a_1$ is parallel to the base plane 26 and, when a golf club, having a striking face and a shaft including a shaft axis, is flushly secured to the pivoting portion 1416*b* of the clamp 1416, the directional axis $a_1$ is parallel to the general plane of the striking face. The stop 1418*c*(3) prevents unintended removal of the first sliding member 1418*c* from the collar member 1418*a*. The stop 1418*c*(3) is removably inserted into the first sliding member 1418*c*. The stop 1418*c*(3) may be removed such that the first sliding member 1418*c* may be removed from the collar member 1418*a* and replaced in a reversed position for measuring the loft and/or lie of a left-handed type golf club. In alternative aspects of the present invention, the stop 1418*c*(3) may be in a spring-biased position, such that a user may push-in the stop 1418*c*(3) to remove the first sliding member 1418*c*.

A first pivoting member 1418*g* is rotatably coupled to the second end 1418*c*(2) of the first sliding member 1418*c*. The first pivoting member 1418*g* pivots about an axis $a_2$. The axis $a_2$ is parallel to the directional axis $a_1$. An angular-displacement sensor (not shown) is associated with the first pivoting member 1418*g* for electronically detecting the angular position of the first pivoting member 1418*g*. The first pivoting member 1418*g* includes a collar portion 1418*g* (1). A second sliding member 1418*d* is slidably engaged with the collar portion 1418*g*(1) of the first rotating member 1418*g*. The second sliding member 1418*d* slides along a directional axis $a_3$. The direction axis $a_3$ is perpendicular to the axis $a_2$. The second sliding member 1418*d* includes a first end 1418*d*(1) and an opposing second end 1418*d*(2). A second stop 1418*d*(3) is located proximate the first end 1418*d*(1). The second stop 1418*d*(3) is removably engaged with the second sliding member 1418*d* for preventing unintended removable of the second sliding member 1418*d*. In alternative aspects of the present invention, the stop 1418*d* (3) may be in a spring-biased position, such that a user may push-in the stop 1418*d*(3) to remove the second sliding member 1418*d*. When the shaft abutment plate 1418*e* flushly engages a shaft of a golf club that is secured to the clamp 1416, the angular-displacement sensor detects the angular position of the shaft abutment plate 1418*e* relative to an angular value when the shaft abutment plate 1418*e* is in a predetermined reference position, and electronically transmits such data to the display 1418*b*, which thereupon calculates and displays a loft angle of the golf club.

A shaft abutment plate 1418*e* includes a front face 1418*e* (1) for flushly engaging with a shaft of a golf club secured to the clamp 1416, and a rear face 1418*e*(2) for fixedly engaging with the second end 1418*d*(2) of the second sliding member 1418*d*. The front face 1418*e*(1) forms a front face plane. Preferably, the front face plane is perpendicular to the directional axis $a_3$. However, in alternative aspects of the present invention, the front face plane is oblique relative to the directional axis $a_3$. A second pivoting member 1418*f* is rotatably coupled to the shaft abutment plate 1418*e*. Specifically, the second pivoting member 1418*f* is rotatable about an axis $a_4$, enabled by a pin 1418*h*. The axis $a_4$ is parallel to the directional axis $a_3$. An angular-displacement sensor (not shown) electronically communicates with the second pivoting member 1418*f* such that, when the second pivoting member 1418*f* flushly engages with a shaft of a golf club, secured to the clamp 1416 and flushly engaged with the shaft abutment plate 1418*e*(1), the sensor detects the angular position of the second pivoting member 1418*f*, transmits such data electronically to the processor associated with the display 1418*b*, and the processor calculates the lie angle of the golf club and causes the display 1418*b* to display the calculated value.

In one or more aspects of the present invention, the shaft abutment plate 1418*e* and/or the second pivoting member 1418*f* include magnetic portions (not shown) for more securely engaging with a shaft of a golf club head, particular if the shaft is undergoing adjustment. Additionally, or alternatively, the shaft abutment plate 1418*e* and/or the second pivoting member 1418*f* include a clamp or hook (not shown) for slidably engaging with a shaft of a golf club, particularly if the shaft is substantially non-ferrous (e.g. a graphite shaft).

Methods of fitting a set of golf clubs to a specific golfer are known. However, common methods of fitting golf clubs fail to sufficiently account for the golfer's performance characteristics as they apply to each golf club of the set. Such fitting methods often result in fitted sets of golf clubs imprecisely customized to a specific golfer, or fitted sets of golf clubs, where only several clubs of the set are precisely customized to the golfer, while others are not. Other known methods tend to be time- and labor-intensive, requiring an undue amount of time for the golfer to test each club. Such methods also tend to involve substantial delay in acquiring the necessary golf club models, assembling each custom golf club of the set, and adjusting each club of the set that requires adjustment.

In one or more aspects of the present invention, as discussed below, a method of fitting a set of golf clubs to a golfer includes various steps. The temporal order of the steps discussed below is by way of example, and not intended to limit the scope of the invention. Unless otherwise indicated, the invention is not limited to the following steps or to the temporal nature of the steps as they are presented.

In one or more aspects of the present invention, a method of fitting a golfer to a set of clubs includes the following steps.

First, a golfer selects a set of iron-type golf clubs, and a set of wedge-type golf clubs heads, and/or individual iron-type or wedge-type golf clubs to form part of a set, from a variety of iron-type and/or wedge-type models. The selection may occur at a club-fitting facility, including a retail store, a repair shop, a pro shop, a golf course, a mobile club-fitting or promotional event, or through a hardware computer over the Internet, or other shared network. In one or more aspects of the present invention, a fitter assists the golfer in selecting a suitable set of iron-type golf clubs and/or wedge-type golf clubs. In one or more aspects of the present invention, the selection is based, in part, on the golfer's age, ability, swing characteristics, accuracy, and/or handicap. One of ordinary skill in the art would appreciate the relationships between these factors and the selection of a model for an iron-type or wedge-type golf club head, as well as appreciate that additional factors, not discussed above, may also contribute to such selection.

Once the golfer selects the appropriate golf club models, the golfer than selects a shaft type for each of the irons and/or wedges selected. For example, the golfer chooses between a stainless steel and a graphite shaft. Alternatively, or in addition, the golfer selects a degree of flex of the shaft. In one or more aspects of the present invention, the selection is aided by a fitter. In one or more aspects of the present invention, the selection of the shaft type is based, in part, on the golfer's age, ability, swing characteristics, accuracy, and/or handicap. One of ordinary skill in the art would appreciate the relationships between the aforementioned factors and the selection of a shaft type and flex for an iron-type or wedge-type golf club head, as well as appreciate that additional factors, not discussed above, may also contribute to such selection.

Once the golfer selects the shaft type and shaft flex, the golfer selects how many of each of iron-type, wedge-type, hybrid-type, fairway wood-type, and wood-type club heads should form the golfer's set. In one or more aspects of the present invention, such selection is aided by a fitter. In one or more aspects of the present invention, such selection is based on the personal preference of the golfer, custom, experience, ability, swing characteristics, handicap, and the types of courses played. One of ordinary skill in the art would appreciate the relationships between the aforementioned factors and the selection of the distribution of clubs in a golfer's set, as well as appreciate that additional factors, not discussed above, may also contribute to such selection.

Next, the golfer selects a desired club length for each golf club of the set. In one aspect of the present invention, the club length, for each club, is based solely on the height of the golfer, and a predetermined relationship between golfer height and club length for one or more golf clubs of a set of golf clubs. Preferably, the selection of golf club length is based on the height of the golfer, the golfer's personal preferences, and an indication of the position of the golfer's hands when addressing a golf ball. Such an indication may be determined by measuring the shortest distance from the ground plane to the junction between the golfer's hands and wrist, when the golfer is addressing a golf ball, or simulating the address of a golf ball. Preferably, the shortest distance is measured when the golfer is gripping a mid-iron, more preferably, a 6-iron. Alternatively, in one or more aspects of the present invention, the golfer grips, as if the golfer is addressing a golf ball, a simulated golf club, that is sized and weighted to feel like a mid-iron, preferably a G-iron. The golfer may reference a table or chart that indicates a suggested club length based on the golfer's height and/or the measured shortest distance for one or more clubs of the golfer's desired set. In one or more aspects of the present invention, the chart indicates a suggested club length for each club of a range of clubs. In one or more aspects of the present invention, the table or chart indicates only a suggested deviation from a standard club length of one or more golf clubs, which the golfer may apply to each golf club of his or her desired set. In one or more aspects of the present invention, a mathematical relationship may be provided to the golfer or to the fitter, upon which the golfer or the fitter is able to calculate a suggested club length based on the factors discussed above, for one or more golf clubs of the golfer's desired set. One of ordinary skill in the art would appreciate that, because a golfer often adapts his or her posture to the length of his or her golf clubs, the determination of an appropriate club length is, in turn, based on a determination of what constitutes appropriate posture, and is, therefore, at least somewhat subjective. Thus, a golfer's own comfort with a particular club length for a particular golf club of a set is a significant, if not overriding, factor. In one or more aspects of the present invention, such selection is aided by a fitter. One of ordinary skill in the art would appreciate additional factors, not discussed above, and may also contribute to the selection of club length for one or more golf clubs of the golfer's desired set.

Once the club lengths of one or more golf clubs of the golfer's desired club set are selected, the golfer selects the type and size of grips for each golf club of the set. In one or more aspects of the present invention, such selection is aided by a fitter. In one or more aspects of the present invention, such selection is based on the personal preference of the golfer, hand size, custom, experience, ability, swing characteristics, handicap, and the types of courses played. One of ordinary skill in the art would appreciate the relationships between the aforementioned factors and the selection of the grip type and/or size, as well as appreciate that additional factors, not discussed above, may also contribute to such selection.

Next, the golfer selects loft angles for each of the wedge-type golf clubs of the golfer's desired set. First, the golfer determines the loft of the highest-lofted wedge that the golfer is able to comfortably use. This determination may be based on the golfer's known preference. In one or more aspects of the present invention, this determination is also based on the golfer's skill level, the golfer's handicap, and actual testing, around a green, at a driving range, or on a golf course, using several wedge-type golf clubs of similar club length, but of different lofts. In one or more aspects of the present invention, the golfer, at this time, may consider additional performance characteristics, such as bounce angle. In one or more aspects of the present invention, the golfer selects the highest-lofted wedge-type golf club that the golfer is comfortable using. In doing so, the golfer generally maximizes the number of high-lofted clubs in his or her desired set, which generally corresponds to increased short-game playability, and reduced score. However, as the loft of the wedge-type golf club increases, all else being equal, greater expertise is generally required to avoid mis-hits. Thus, the maximum loft of the golfer's highest loft wedge-type golf club may be particularly limited by the golfer's skill level.

Once the loft of the highest-lofted wedge is determined, the loft of each other wedge is determined. In one or more aspects of the present invention, the loft of each other wedge is determined by considering the loft of the highest-lofted iron-type golf club of the golfer's desired set and the loft of the golfer's highest-lofted wedge. The loft of each other wedge-type golf club is selected such that the loft intervals between each progressive wedge-type golf club and the highest-lofted iron-type golf club are equal. If the golfer's desired set of iron-type golf clubs includes a pitching wedge, then the pitching wedge should be considered the highest-lofted iron-type golf club. In one or more aspects of the present invention, if the total gap in loft between the golfer's highest-lofted iron-type golf club and highest-lofted wedge-type golf club is relatively small, or relatively large, the golfer may reconsider the number of wedges that the golfer's desired set includes. Wedges having the desired lofts are then selected. Alternatively, wedges not having such lofts are selected and adjusted to have such lofts. In one or more aspects of the present invention, the golfer then tests each wedge. In some aspects of the present invention, upon re-testing of each wedge, if the golfer is not comfortable with one or more of the wedges, such wedges are re-adjusted appropriately.

Next, the lie angles of each of the iron-type and wedge-type golf clubs of the golfer's desired set of golf clubs are customized. In one or more aspects of the present invention, the golfer is provided with a representative golf club from predetermined subsets of the iron-type and wedge-type golf clubs. For example, the golfer is provided with a #8-iron, a #5-iron, and a sand-wedge. The #8-iron is representative of the subset of mid-irons, the #5-iron is representative of the long-irons, and the sand-wedge is representative of the wedges. In one or more aspects of the present invention, for each representative golf club, lie tape is applied to the sole of the golf club, and the golfer strikes a golf ball on a lie board. A marking is formed on the lie tape as a result of the strike. The marking indicates if any adjustment to the lie angle of the golf club is needed, e.g. if the golf club is upright or flat, and the necessary degree of adjustment, if any. In some aspects of the present invention, in addition to analyzing the lie tape, the fitter also analyzes ball flight characteristics upon the golfer's impact, i.e. whether or not the golfer's hit ball is straight. Based on the results of the lie test, and/or ball-flight characteristics, the fitter adjusts the lie angles of each of the representative golf clubs, as required. In one or more aspects of the present invention, this process is repeated, i.e. the representative golf clubs are re-tested by the golfer, and re-adjusted by the fitter, until the impact marking on the lie tape indicate that the golf club is properly adjusted, i.e. the marking is centered, and/or the ball flight trajectory is straight.

Once the representative golf clubs are properly adjusted for lie, each remaining golf club is adjusted in similar manner to the representative golf club of the group to which each golf club belongs. In one or more aspects of the present invention, the golf club representative of the long irons is tested and adjusted first, followed by a golf club representative of the mid- to long-irons, and followed by a golf club representative of the wedges. Thus, the golf clubs most likely to produce the most accurate readings are tested first, such that any later tests indicating lie angles that substantially deviate from prior measurements would be conspicuous, and, as a result, would not result in an undue number of adjustments and/or unnecessarily increase the overall time of the club fitting. In some aspects of the present invention, clubs of the same subset of the tested representative clubs are adjusted to have the same lie angle as the representative golf clubs. In alternative aspects of the present invention, the lie angles for the remaining golf clubs are interpolated based on the determined desired lie angle of the representative golf clubs. In other words, the remaining lie angles are determined, such that the lie angle per each progressive golf club of the set follows a generally linear, or quasi-linear, relationship. In some aspects of the present invention, the remaining golf clubs are adjusted for lie based on the determined lie angle of each representative golf club and based on a predetermined relationship between lie angle, loft, and/or club length.

In one or more aspects of the present invention, the golf club representative of the mid- and long-irons is tested first, followed by the representative golf club of the long irons, and, thereafter, the golf club representative of the wedges. In alternative aspects of the present invention, only two representative golf clubs are tested, e.g., a golf club representative of the irons, and a golf club representative of the wedges. In yet other aspects of the present invention, at least four representative golf clubs are tested. In still yet other aspects of the present invention, each of the iron-type and wedge-type golf clubs are tested on the basis of desired lie angle. In this case, precision is enhanced. However, the overall fitting process, in this case, may be time-consuming. In one or more aspects of the present invention, the step of fitting each iron-type and wedge-type golf club of the golfer's desired set for correcting lie angle occurs before a step of fitting each iron-type and wedge-type golf club of the golfer's desired set for correcting loft angle. However, in alternative aspects of the present invention, these steps are reversed, or, in some aspects, conducted simultaneously. In one or more aspects of the present invention, after each club head is adjusted for lie angle, the golfer tests each one, and, if any further corrections in lie angle are necessary, such adjustments are made. Preferably, the adjustment of the lie angle of each golf club requiring adjustment is conducted locally, by a portable-type club head bending device. Preferably, the bending device is automated, such that the bending operation is electrical-power assisted.

Next, the golf clubs are adjusted such that gaps in the golfer's average ball flight distance, associated with each progressive golf club, are consistent. Specifically, the golfer hits golf balls for each golf club of the set of irons and the set of wedges. The ball flight distance is recorded for each golf club. In alternative aspects of the present invention, the golfer hits only some of the golf clubs of the set of irons and the set of wedges. In some aspects of the present invention, ball flight distances are determined by an electronic launch monitor. Preferably, the golfer begins with the highest-lofted wedge and tests each progressive decreasingly-lofted golf club therefrom. However, in alternative aspects of the present invention, the golfer may begin with the lowest-lofted iron, and test each progressively higher-lofted golf club. In yet other aspects of the present invention, the golfer tests each golf club of the desired set in an arbitrary order. In this manner, the ball flight distance results may be considered more authentic, as a golfer must often switch between golf clubs having wide variation in loft during the actual game of golf. Then, the recorded ball flight distances are considered. If the gaps between the ball flight distances of each progressively-lofted golf club are consistent, no further adjustment is necessary. However, if any inconsistencies are found, one or more golf clubs are adjusted for loft to correct the inconsistency in average ball flight distance. In some aspects of the present invention, after each adjustment, the adjusted golf club is re-tested, and re-adjusted if necessary. In some aspects of the present invention, the loft angle is adjusted on the basis of a predetermined relationship between loft angle, and average ball flight distance. In some aspects of the present invention, if an inconsistency in gap exists, a demo golf club, similar to the golf club necessitating adjustment, but having a different loft angle, may be substituted to minimize, or eliminate, iterative adjustments, particularly in the case of short irons and wedges. Preferably, each adjustment of the loft angle of each golf club to be adjusted is conducted locally, by a portable-type club head bending device. Preferably, the bending device is automated, such that the bending operation is electrical-power assisted.

In one or more aspects of the present invention, one or more golf clubs are re-tested and any necessary final adjustments are made to the lie angle, bounce angle, and/or loft angle of the golf club requiring adjustment.

In one or more aspects of the present invention, after any, or some, of the steps of grip selection, club length selection, adjustment of the loft angle, and adjustment of the lie angle, as applied to one or more golf clubs, a swing weight of one or more golf clubs of the desired set are measured. In some aspects of the present invention, if any inconsistencies are introduced in the swing weight of one or more of the golf clubs of the desired set, or unintended changes in the swing weight occur, the fitter adjusts the swing weight of the one or more golf clubs such that the swing weights of each golf club of the set are consistent, or otherwise conform to the golfer's desires. Such swing weight adjustment may be accomplished by the application of lead tape, a polishing or grinding of a portion of the golf club head, or the like.

In one or more aspects of the present invention, a custom golf club fitting in accordance with any of the methods discussed above is conducted at a club-fitting facility, remote from a golf club manufacturer. To facilitate an efficient fitting program, the manufacturer preferably supplies to the remote club-fitting facility, a plurality of models of iron-type and/or wedge-type golf club sets. In addition, the manufacturer preferably supplies, to the remote club-fitting facility, unassembled, or partially-assembled, golf club components, for example, individual golf club heads, individual golf club shafts, individual grips, and/or golf clubs assembled without grips. By providing such products and components to the remote club-fitting facility, the club selection is enhanced, while the total number of golf clubs that the club-fitting facility is required to carry is minimized.

In some aspects of the present invention, the manufacturer supplies, to the remote club-fitting facility, demo golf clubs that vary from standard golf clubs in loft angle and/or lie angle. Upon receipt, the demo golf clubs may be offered by the fitter to the golfer, to be used in the club-fitting methods discussed above. For example, a #5-iron demo golf club having a lie angle one degree higher than the corresponding #5-iron of the golfer's desired set may be tested by the golfer to determine if an adjustment of an additional one degree of lie angle will be sufficient to result in a centered sole impact, using the lie board test discussed above, without yet performing the adjustment to the golfer's set. In one or more aspects of the present invention, the manufacturer provides, to the remote club-fitting facility, a set of demo clubs including a set of wedges of a particular club model. Preferably, the set of demo clubs progressively increase in loft in equal intervals and includes at least 4 wedges. More preferably, the demo set of wedges progressively increase in loft in equal intervals and includes at least 8 wedges.

While various features have been described in conjunction with the aspects outlined above, various alternatives, modifications, variations, and/or improvements of those features and/or aspects may be possible. Accordingly, the aspects, as set forth above, are intended to be only illustrative. Various changes may be made without departing from the broad spirit and scope of the underlying principles.

We claim:

1. An apparatus for reconfiguring a golf club head, the apparatus comprising:
- a coupling;
- a coupling head for associating the coupling with the golf club head;
- a base having a base plane;
- a clamp for associating the golf club head with the base; and
- an actuator associated with the base, the actuator comprising:
  - an actuation axis substantially non-parallel to the base plane, the actuation axis being a path of movement of a driver of the actuator; and
  - an output engagement portion adapted to slideably engage with a portion of the coupling, wherein the engagement enables the portion of the coupling to rotate arcuately along an imaginary plane including the actuation axis.

2. The apparatus of claim 1, wherein the actuator is non-pivotally associated with the base.

3. The apparatus of claim 1, wherein the portion of the coupling comprises an elongated section.

4. The apparatus of claim 3, wherein the coupling comprises an elbow intermediate the coupling head and the portion of the coupling.

5. The apparatus of claim 1, further comprising a movable cart associated with the base.

6. The apparatus of claim 1, wherein a combined weight of the actuator, the base and the clamp is less than 100 lbs.

7. The apparatus of claim 1, wherein the base comprises a material chosen from the group consisting of aluminum, magnesium, titanium, steel, wood and a polymeric material.

8. The apparatus of claim 1, wherein the base comprises a first actuator mount and a second actuator mount for associating the actuator with the base.

9. The apparatus of claim 8, wherein the first actuator mount is configured to associate the actuator with the base in a first position, and the second actuator mount is configured to associate the actuator with the base in a second position.

10. The apparatus of claim 9, wherein, when the actuator is in the first position, the actuation axis is inclined 35 to 70 degrees relative to the base plane.

11. The apparatus of claim 9, wherein, when the actuator is in the second position, the actuation axis is inclined 55 to 65 degrees relative to the base plane.

12. An apparatus for reconfiguring a golf club head, the apparatus comprising:
- a coupling;
- a coupling head for associating the coupling with the golf club head;
- a base having a base plane;
- a clamp for associating the golf club head with the base; and
- an actuator associated with the base, the actuator comprising:
  - an actuation axis substantially non-parallel to the base plane, the actuation axis being a path of movement of a driver of the actuator; and
  - an output engagement portion adapted to slideably engage with a portion of the coupling, wherein the engagement enables the portion of the coupling to rotate along an imaginary plane including the actuation axis.

* * * * *